US006394796B1

(12) United States Patent
Smith

(10) Patent No.: US 6,394,796 B1
(45) Date of Patent: May 28, 2002

(54) CURING OVEN COMBINING METHODS OF HEATING

(76) Inventor: Alan D. Smith, Box 453, MacArthur, WV (US) 25873

( * ) Notice: Subject to any disclaimer, the term of this patent is extended or adjusted under 35 U.S.C. 154(b) by 0 days.

(21) Appl. No.: 09/706,939

(22) Filed: Nov. 6, 2000

Related U.S. Application Data

(60) Provisional application No. 60/163,503, filed on Nov. 4, 1999.

(51) Int. Cl.[7] ..... F27D 19/00
(52) U.S. Cl. ..... 432/229; 432/19
(58) Field of Search ..... 432/9, 19, 37, 432/42, 45, 49, 175, 229; 228/9

(56) References Cited

U.S. PATENT DOCUMENTS

| | | | | |
|---|---|---|---|---|
| 5,070,625 A | * | 12/1991 | Urquhart | 34/39 |
| 5,205,273 A | | 4/1993 | Sparks et al. | 126/21 |
| 5,588,830 A | | 12/1996 | Josefsson et al. | 432/147 |
| 5,590,238 A | * | 12/1996 | Ericson | 432/229 |
| 5,676,044 A | | 10/1997 | Lara, Jr. | 99/331 |
| 5,793,019 A | | 8/1998 | Boyle et al. | 219/400 |
| 5,836,085 A | | 11/1998 | Ben-Ezra | 34/270 |
| 6,168,064 B1 | * | 1/2001 | Berkin | 432/37 |

* cited by examiner

*Primary Examiner*—Gregory Wilson
(74) *Attorney, Agent, or Firm*—Steptoe & Johnson PLLC

(57) ABSTRACT

An oven having one or more independently adjusted radiant heaters that can be dynamically adjusted before and during a curing or heating process to account for the shape and size of an object being cured or heated, further comprising a means for dynamically controlling the level of heat output from the radiant heaters. The oven preferably has radiant heaters positioned on opposing sides of the object and one or more back panels positioned behind the radiant heaters to absorb any radiant heat that misses the object. The oven of the present invention also has a turbulent fan and a means for deflecting the air flow of the convection heat throughout the internal oven chamber and toward the object. In addition, the oven has an exhaust fan that can discharge the exhaust either outside of the oven or redirect the exhaust back into the oven chamber to raise the ambient temperature, depending on the application for which the oven is being used. A computer system uses one or more object sensors and ambient sensors to control the radiant heaters (both position and level of heat output), the turbulent fan, the exhaust fan, and water flow to the object sensor. The oven of the present invention combines three different types of method of heating: convection, ambient, and radiant. +

39 Claims, 24 Drawing Sheets

CURING OVEN COMBINING METHODS OF HEATING

CROSS REFERENCE TO RELATED APPLICATIONS

This application claims the benefit of Application No. 60/163,503, filed Nov. 4, 1999.

BACKGROUND OF THE INVENTION

1. Field of the Invention

This invention relates to ovens, and more specifically, to ovens using independently controlled radiant heaters, both position and levels of heat output, with the optional combining of different methods of heating including ambient, convection, and radiant heat.

2. Related Art

Conventional curing ovens typically use one of three methods of heat transfer: convection, ambient, or radiant. Regarding the use of radiant heaters, such curing ovens typically use only one radiant heater which is locked in a fixed position. That is, the radiant heater is not dynamically movable to adjust the direction of the radiant heat emitted from the heater nor is the level of heat output from the radiant heater dynamically controlled. This results in an inefficient means for curing an object because the maximum effect of the heater cannot be customized or adjusted for different shaped objects being cured or for objects combining different compositions.

For example, in U.S. Pat. No. 5,836,085 to Ben-Ezra, an improved paint-spraying and curing booth is disclosed having direct fired U-tube radiant heaters. The radiant heaters are built into the radiant heating system, thereby being fixed in position. The radiant heaters are not movable or adjustable. Therefore, regardless of the size or shape of an object placed within the paint-spraying and curing oven, the radiant heaters will emit heat in the same direction and at the same angle every time. The same problem exists with the ovens disclosed in U.S. Pat. No. 5,588,830 to Josefsson, et al., and in U.S. Pat. No. 5,205,273 to Sparks, et al.

Therefore, there is a need for an oven having one or more radiant heaters that are dynamically movable such that the radiant heaters can be adjusted to maximize the efficiency of the emitted heat according to the size and/or shape of an object being cured/heated within the oven. There is a further need for an oven in which the levels of heat output from the radiant heaters can be dynamically controlled during the curing/heating process.

In addition to using fixed radiant heaters, a conventional curing oven may also combine two different methods of heat transfer, but there does not exist a curing oven that combines all three methods of heating. In the '830 Patent to Josefsson, et al., a combined radiant and convention heating oven is disclosed wherein the convection air is controlled independent of the radiant heat surfaces. The convection air is circulated via a plurality of fans that are controlled by a plurality of frequency motor drive units. The temperature of the radiating surfaces are controlled by heated air flowing through ducts extending longitudinally through the oven that abut the radiating surfaces. Optionally, dampers may be incorporated into the ducts to provide individual control to each radiating surface. An important feature of the Josefsson oven is the placement and use of a temperature sensor. The temperature sensor is placed in a return plenum to determine the convection air temperature. This temperature is then input into a control device which uses the convection temperature to control the speed of the fans and the amount of fuel supplied to the burners.

There are several disadvantages to the Josefsson heating oven, but the principal problem is the temperature sensor. By placing the temperature sensor in a location, e.g., the return plenum, for determining the convection air temperature, the object being cured can easily be either under-baked or over-baked. When an object, having bolts or the other components attached thereto, is under-baked, the paint will flake when a bolt is removed. When an object is over-baked, the paint becomes discolored.

Therefore, there is a need for a curing oven that combines ambient, convection, and radiant methods of heating that ensures a constant and uniform temperature of the object during the curing process.

SUMMARY OF THE INVENTION

The present invention is an oven having independently movable radiant heaters, wherein the levels of heat output from the radiant heaters also are dynamically controlled, and that optionally combines three types of heat: convection, ambient, and radiant. The oven comprises one or more adjustable U-Tube radiant heaters on each side of the internal oven chamber. The radiant heaters can pivot horizontally toward the object being heated as well as pivot vertically to direct the focus of the heaters, thereby taking into account the shape and size of the object. One or more back panels, preferably colored flat black, are positioned behind the radiant heaters to capture any radiant energy emitted from the radiant heaters that misses the object.

The oven of the present invention is directed to a curing oven being used for the powder based paint curing of an object; however, this is for convenience purpose only. The oven of the present invention can be adapted for use in pre-baking, baking, or drying-off an object, or in any other oven application requiring the heating of an object.

In the present invention, the oven can discharge the heat exhaust from the radiant heaters to either outside of the oven or back within the oven chamber, depending on the object being heated and the type of heating application, to help reach a maximum ambient temperature. This results in achieving ambient temperatures of 300–500 degrees much faster.

A conventional turbulent fan may be positioned on the top or side of the oven that works in combination with an air direction unit and a means for deflecting the airflow to circulate air within the oven chamber. The preferred means for deflecting airflow is one or more deflectors positioned along the walls of the oven chamber. The use of deflectors is beneficial to the heating process because they reduce dust build-up and are easier to clean than conventional duct work.

The radiant heaters, turbulent fan (convection heat), and ambient temperature (managed via the radiant heaters, exhaust fan and back panels) are all controlled by a computer system connected to one or more temperature sensors monitoring the temperature of the object being cured and the ambient temperature within the oven chamber. There are many advantages to the oven of the present invention. By dynamically controlling the position, direction, and level of heat (turning on and off) of the radiant heaters, the time needed to cure/heat an object is greatly reduced. The cure time is also improved due to the combination of convection, ambient, and radiant methods of heat. The following table illustrates sample test data for curing 14 gauge steel according to the present invention:

| Method of Heating | Time to Cure (Minutes) |
|---|---|
| Ambient only | 40 |
| Ambient + Radiant | 20 |
| Ambient + Radiant + Convection (Present Invention) | 6 |

A curing oven of the present invention also requires much less fuel during operation. For example, a thirty (30) minute test using the present invention requires only 1/10th of a cubic foot of gas to maintain a proper cure. In addition, the curing oven of the present invention can be used with either powder based or water based paint. The curing oven also eliminates the majority of the EPA and OSHA problems associated with conventional spray painting of objects.

The oven of the present invention also maximizes the use of radiant heaters by allowing the radiant heaters the ability to pivot toward the object being cured or heated. In the preferred embodiment, the radiant heaters can pivot to within 6" of the object as well as pivot vertically the direction of the emitted heat. The position of the radiant heaters also are adjusted dynamically during the entire curing/heating process, thereby ensuring proper curing at all times.

Furthermore, this pivoting of the radiant heaters and dynamic control of the level of heat from the radiant heaters provides the means for proportionally curing or heating an object from top to bottom. That is, the heating of an object can be customized according to the composition of the object. To properly cure an object, one portion, e.g., the bottom, may require slower cure time than another portion, e.g., the top, of the object, such as if the two portions were made from different gauges of steel. Therefore, to enable the object to be cured within the same time frame, thereby ensuring a proper and uniform cure, the radiant heaters may be controlled such that the bottom portion of the object cures at a lower temperature (and slower) than the top portion. In this example, one or more radiant heaters may be farther away from the bottom portion of the object and directed to a lower level of heat, whereas one or more other radiant heaters may be moved in closer to the top portion of the object and directed to a higher level of heat, resulting in the top and bottom portions of the object completing the cure process at the same time.

Lastly, one or more temperature sensors of the present invention is used to measure the temperature of the object being cured as well as the ambient temperature within the oven chamber. This is an important distinction over the prior art in that the prior art typically measures only the ambient temperature within the curing oven, and the temperature of an object being cured is always higher than the ambient and convection temperatures. Therefore, conventional curing ovens improperly heats an object resulting in the object being overbaked or underbaked. In contrast, by measuring the temperature of the object being cured, the object will never be incorrectly cured.

BRIEF DESCRIPTION OF THE FIGURES

The present invention is described with reference to the accompanying drawing. In the drawing, like reference numbers indicate identical or functionally similar elements. Additionally, the left-most digit of a reference number identifies the drawing in which the reference number first appears.

DETAILED DESCRIPTION OF THE PREFERRED EMBODIMENTS

I. The Curing Oven

All dimensions used in the preferred embodiment are for convenience purpose only. It would be readily apparent to one of ordinary skill in the relevant arts to design and build an oven of the present invention using different dimensions and comparable components. It also is believed that the oven of the present invention is described in sufficient detail such that one of ordinary skill in the relevant art can design, manufacture, and use such an apparatus. Furthermore, the oven of the present invention is described in terms of a curing oven for curing a painted object, but this is for convenience purposes only. The oven of the present invention, and all of its features, can be used for any purpose, including, but not limited to pre-baking, baking, drying-off, curing, and heating an object.

A. Structure

Figure 6:
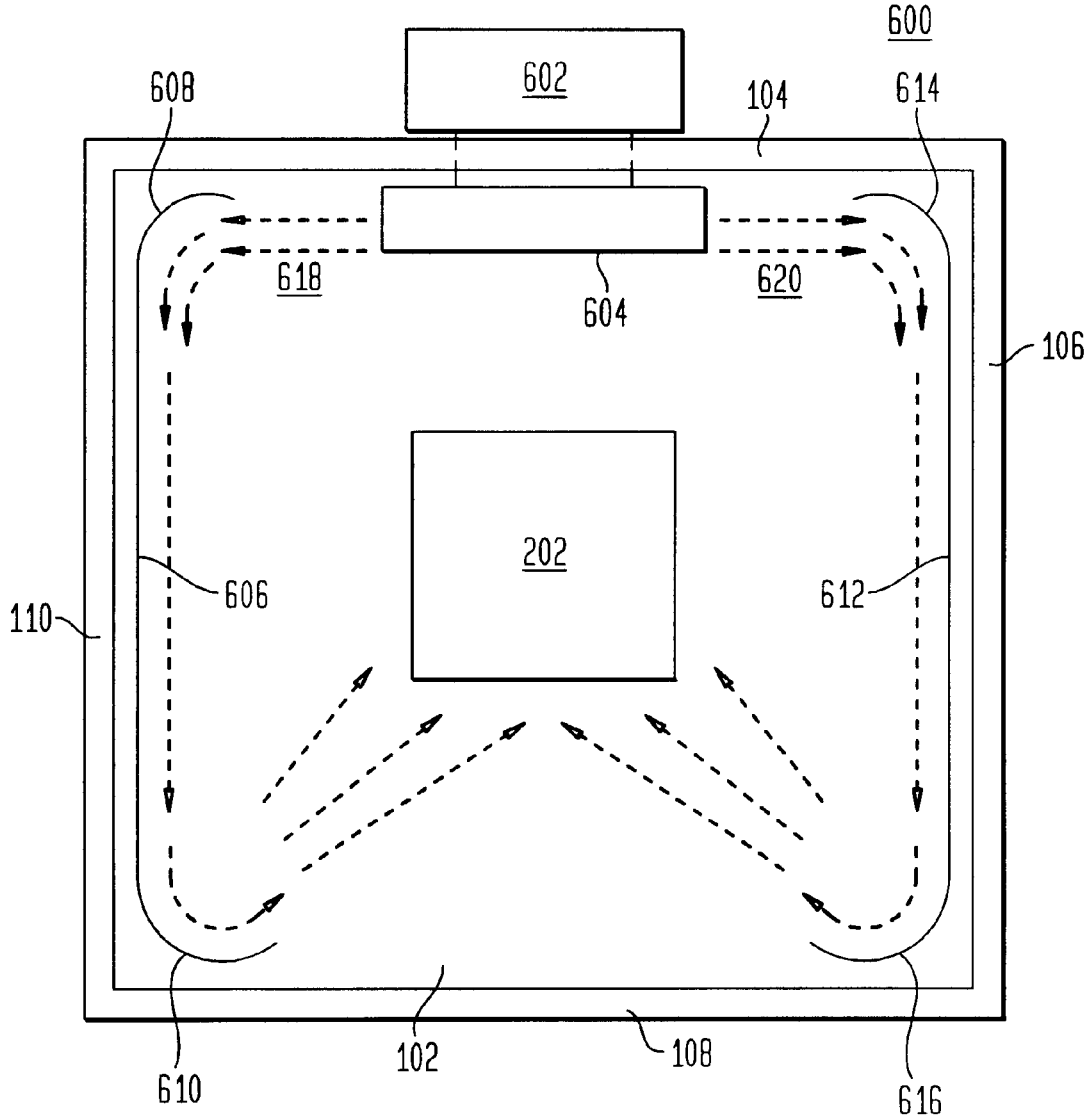
FIG. 6: A planar front view of an oven of the present invention with a turbulent fan.

FIG. 1–5 show the preferred embodiment of a cross section of an oven 100 of the present invention, while FIG. 6 shows the oven 600 with a turbulent fan 602. The oven 100 comprises an oven chamber 102 having a top 104, a first side wall 106, a bottom 108, a second side wall 110, a front wall and a back wall. In the preferred embodiment, the oven 100 is made of steel and is about 8'×8'×40', but it would be readily apparent for one of ordinary skill to build an oven 100 of the present invention to any dimensions. The oven chamber 102 is a closed-door cabinet having a double-door on opposing sides of the oven 100, such as a first double door on the front wall and a second double door 112, 114 on the back wall, to allow for an assembly line application to be achieved for curing/heating an object 202. That is, an object 202 to be cured or heated is suspended by a central rail 116 and is moved through a first set of double-doors and into the oven chamber 102 of the oven 100. After the curing/heating of the object 202 is complete, the second set of double doors 112, 114 are opened and the object 202 is moved through the double doors 112, 114 and out of the oven 100. One or more doors 112, 114 may incorporate a viewing window to allow a user to observe an object within the oven chamber 102. The number and placement of doors 112, 114 is for convenience only. The oven 100 of the present invention can be designed and manufactured with any number of doors 112, 114 and placement of such doors 112, 114.

In the preferred embodiment, there are three radiant heaters 120*a–c* positioned on the first side wall 106 and three radiant heaters 120*d–f* positioned on the second side wall 110 of the oven 100, wherein the radiant heaters 120*a–f* are vertically aligned. Each set of radiant heaters has a top radiant heater 120*a,d*; a middle radiant heater 120*b,e*; and bottom radiant heater 104*c,f*.

The present invention incorporates conventional U-tube radiant heaters 120*a–f* that are uniquely mounted; that is, each radiant heater 120*a–f* is pivotally mounted to a radiant heater support bar 118*a,b* such that the radiant heaters 120*a–b* pivot about two points. The mounting is described in reference to a single radiant heater, such as top radiant heater 120*a* for convenience purpose only. It is equally applicable to all of the radiant heaters 120*a–f*.

First, the top radiant heater 120*a* is pivotally mounted to an L-shaped bracket 122*a*, resulting in the top radiant heater 120 being able to pivot about a central point in relation to the L-shaped bracket 122*a* such that the heat emitted from the top radiant heater 120*a* moves in a vertical plane as the top radiant heater 120*a* is pivoted. Second, the L-shaped bracket 122*a* is pivotally mounted to a radiant heater support bar 118*a*, resulting in the L-shaped bracket 122*a* being able to pivot in relation to the radiant heater support bar 118*a* such that the top radiant heater 120*a* moves in a horizontal plane toward and away from the object 202.

In operation, the L-shaped bracket 122*a* of the top radiant heater 120*a* is swung toward or away from an object 202 being cured/heated, then the top radiant heater 120*a* itself can be pivoted around the L-shaped bracket 122*a* to point its heat directly at the object 202 or a portion thereof This provides a means for moving each of the radiant heaters 120*a–f* to cure/heat a specific portion of the object 202. An L-shaped bracket 122*a* is used for convenience purpose only. It would be readily apparent for one of ordinary skill in the relevant art to use a comparable means for pivotally mounting the radiant heaters 120*a–f* In the preferred embodiment, the radiant heaters 122*a–f* are conventional and commercially available U-Tube radiant heaters.

To provide for this means for moving the radiant heaters 120*a–f*, the blower units 304, 306, 404, 406 of the radiant heaters 120*a–f* must be rotatably connected to the radiant heaters 120*a–f*. In conventional curing ovens, a conventional radiant heater is rigidly connected to a blower unit, thereby preventing the rotation of the radiant heater in relation to the blower unit. In contrast, the present invention uses a new coupling between a blower unit and a radiant heater.

Figure 1:
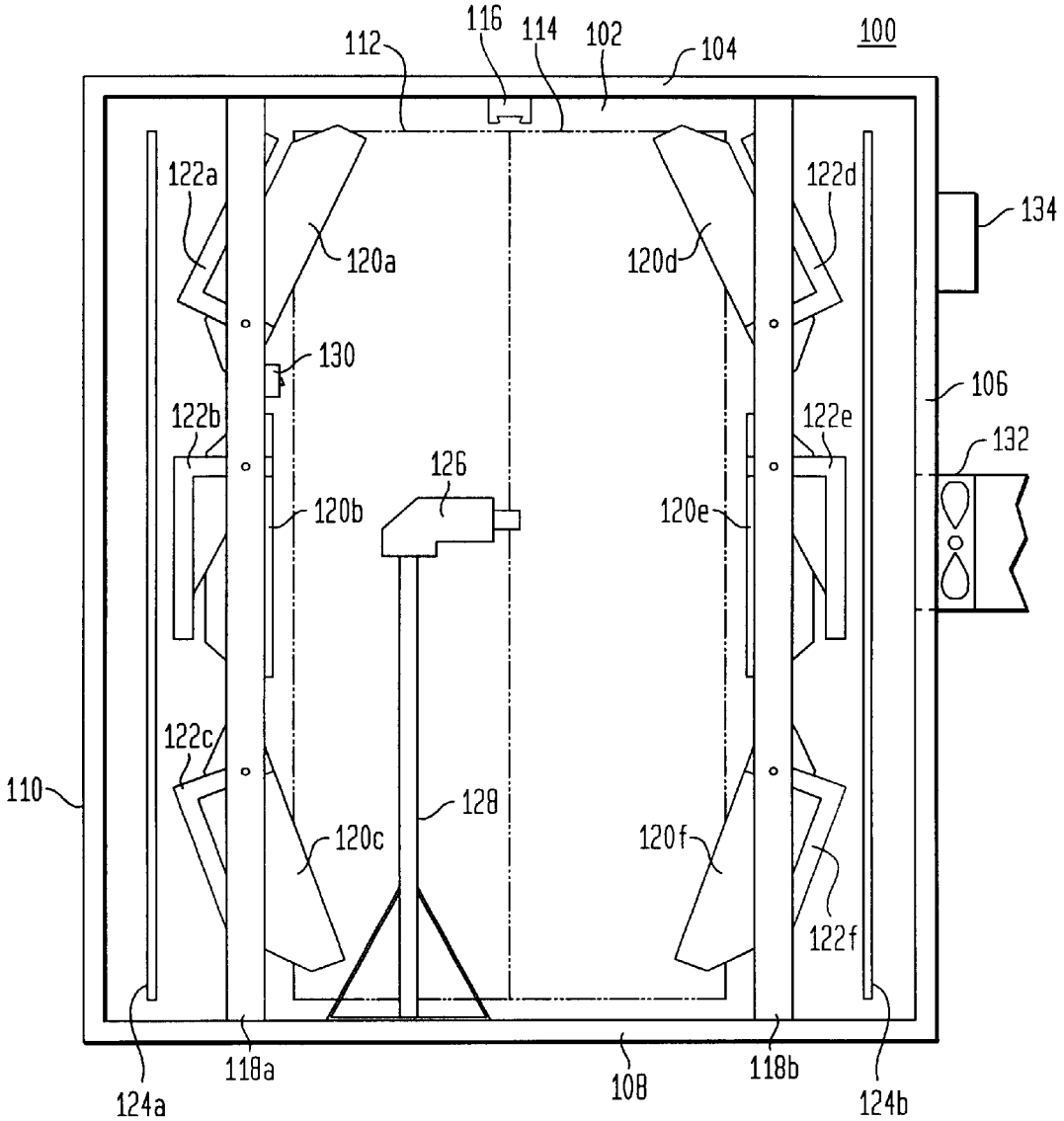
FIG. 1: A planar cross sectional view of an oven of the present invention showing the preferred means for heating using radiant heat.
Figure 2:
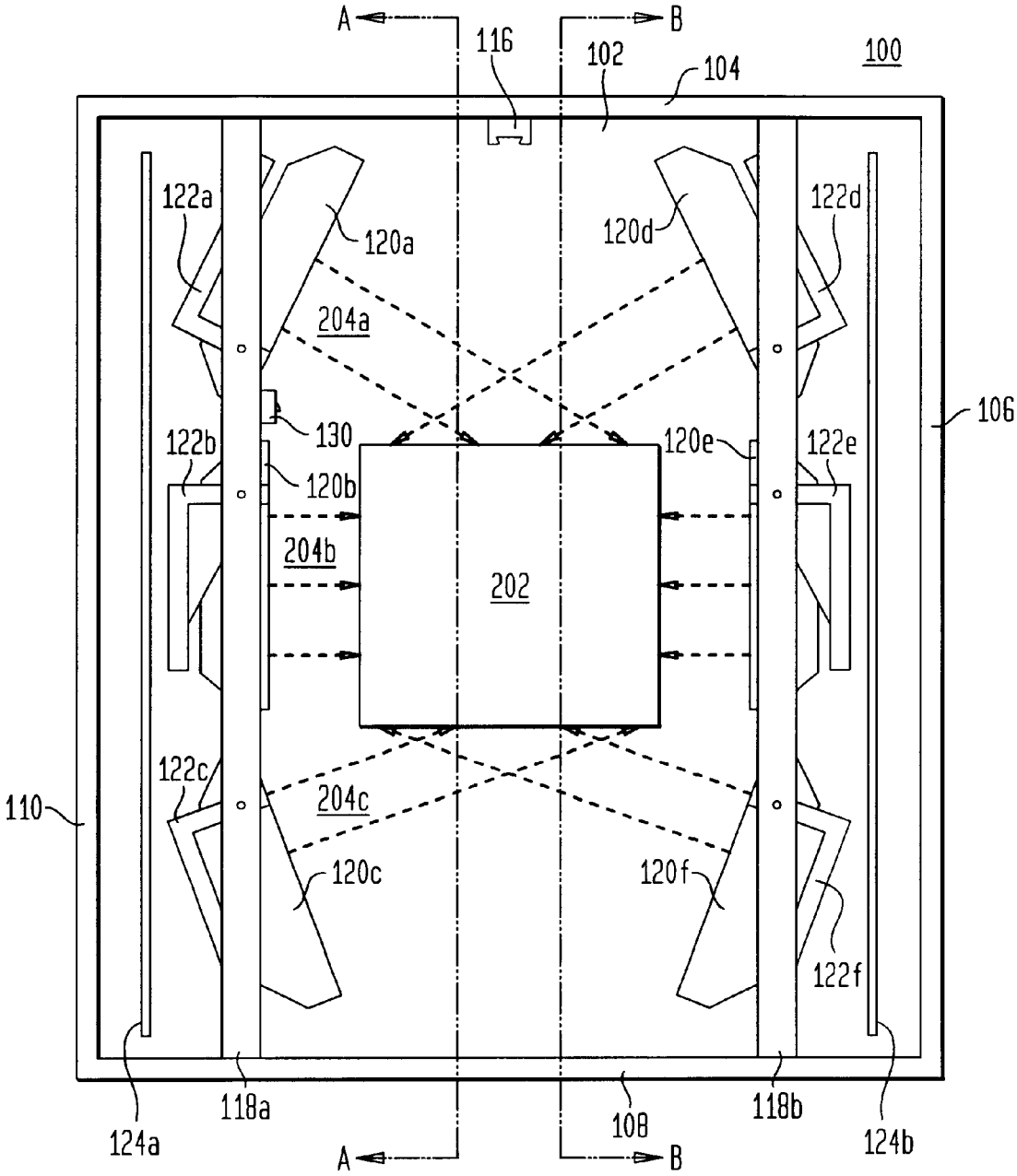
FIG. 2: A planar cross sectional view of the oven showing the heating of an object.
Figure 3:
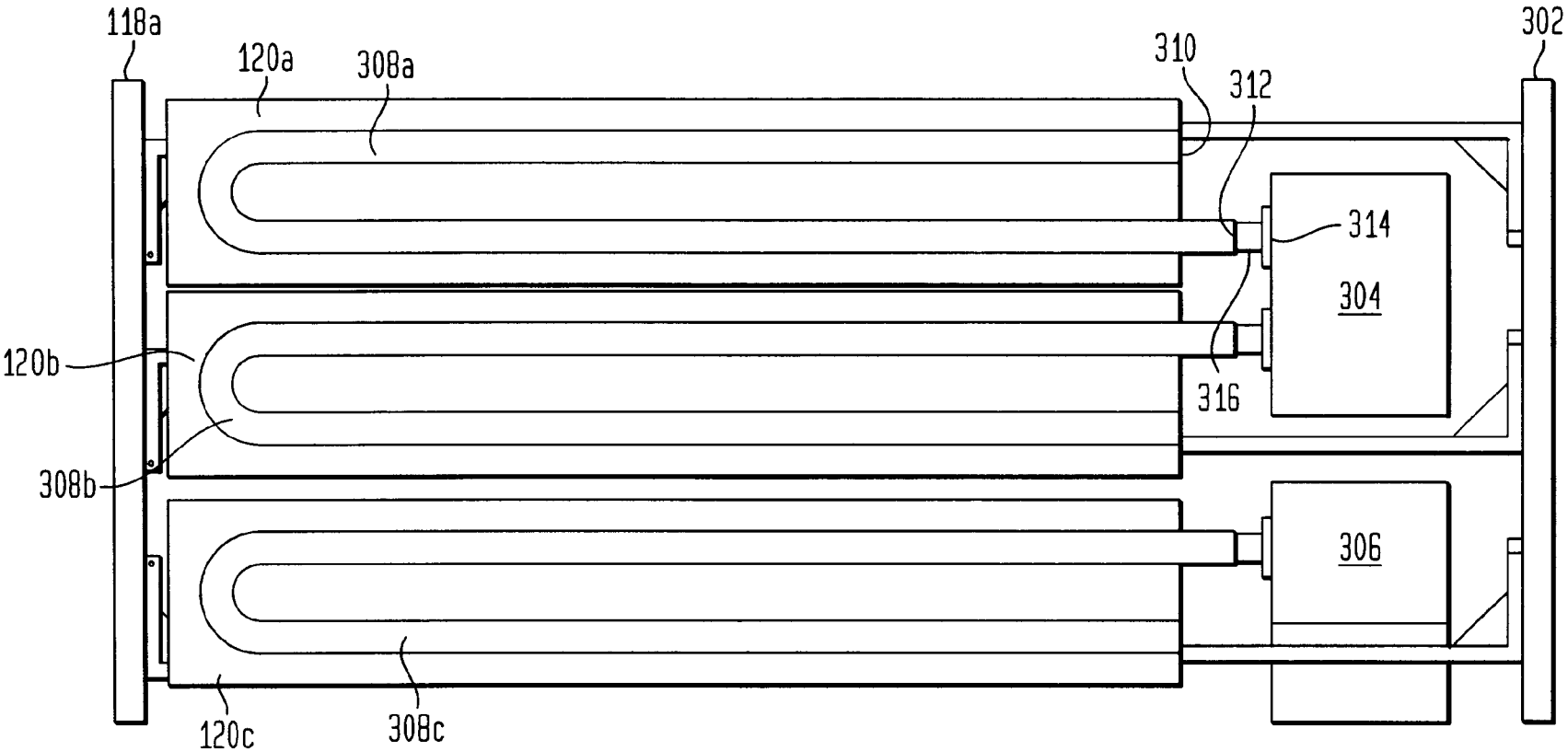
FIG. 3: A planar front view of panel A of radiant heaters.
Figure 4:
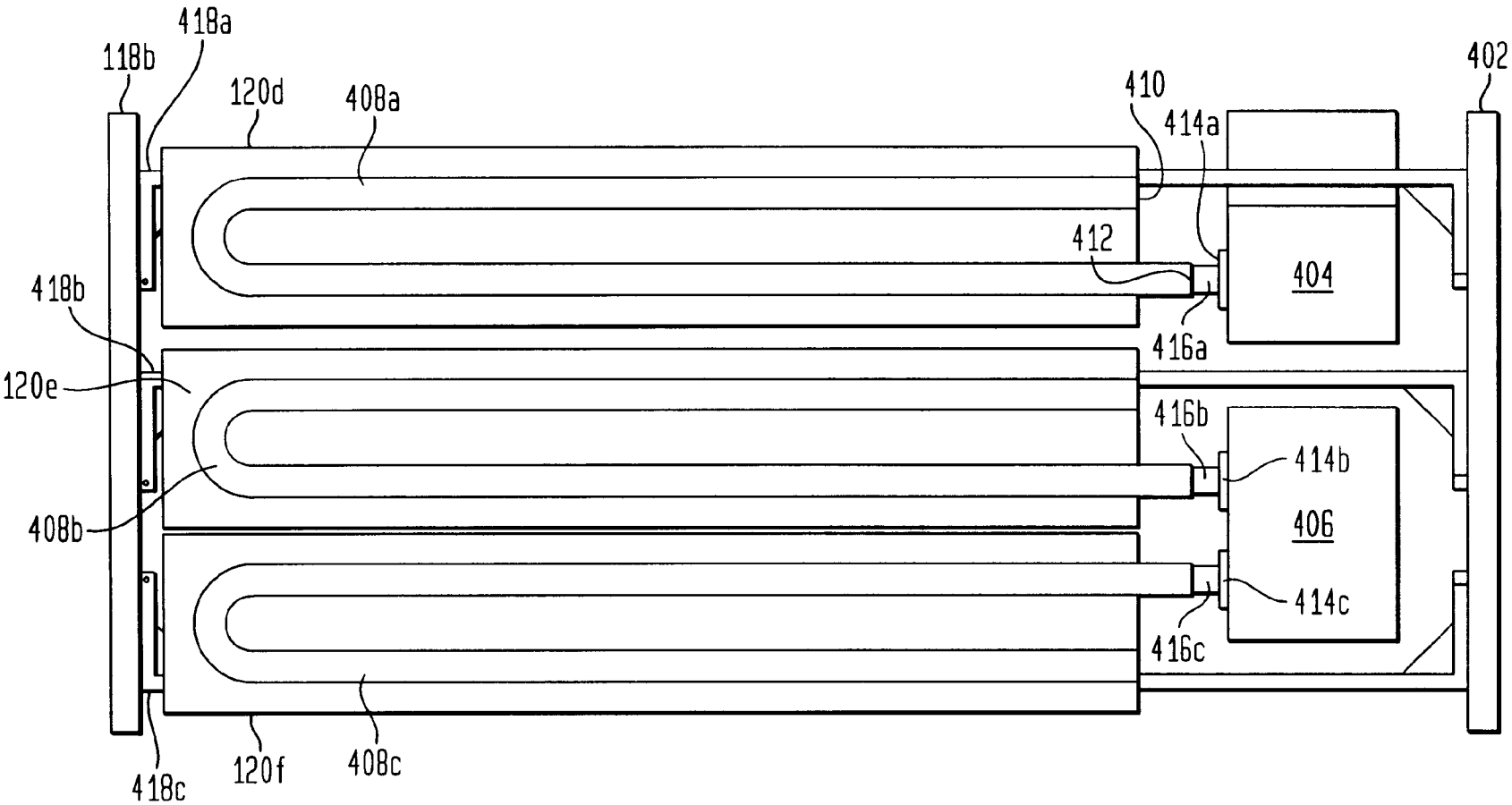
FIG. 4: A planar front view of panel B of radiant heaters.
Figure 5:
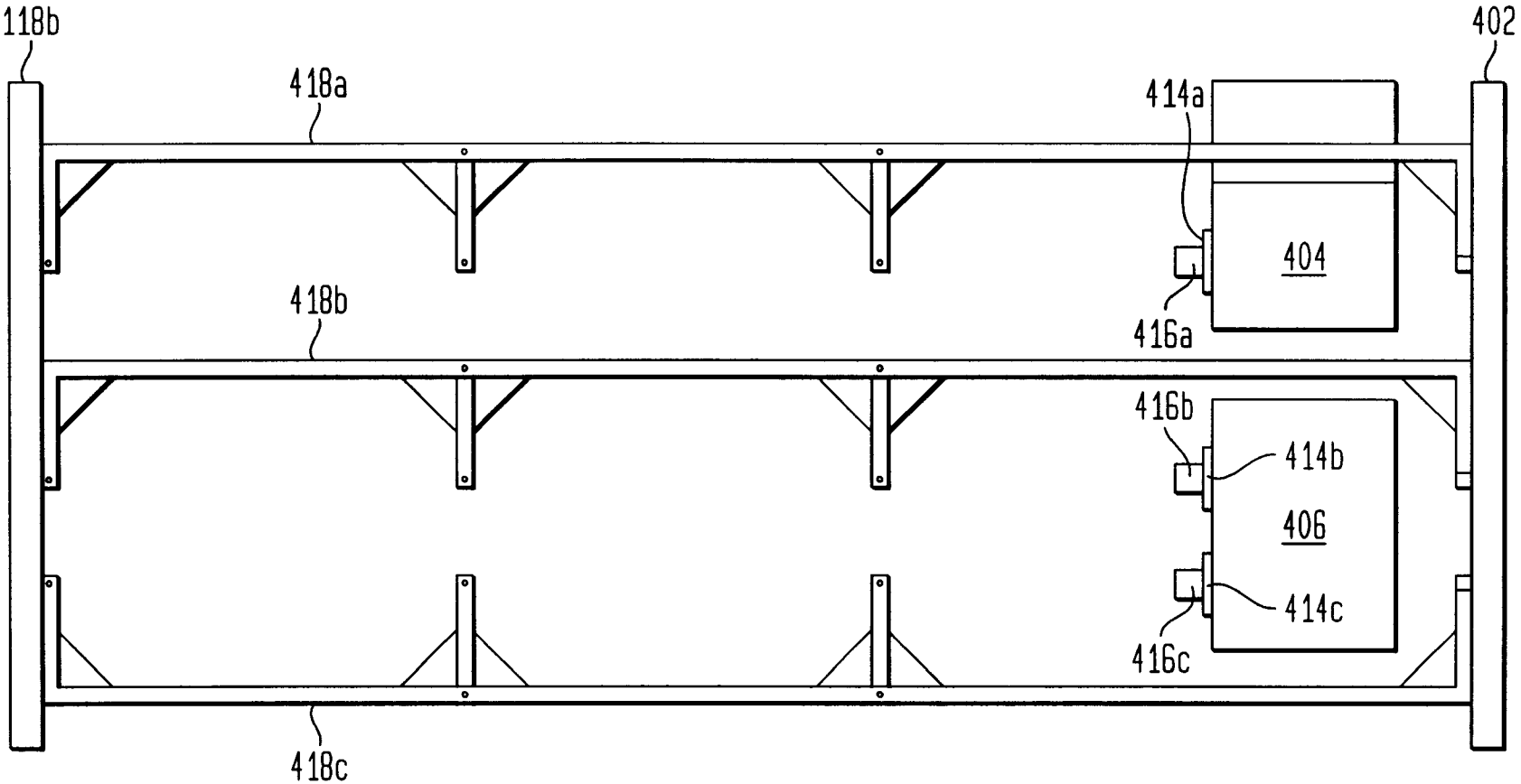
FIG. 5: A planar front view of a framework for mounting panel B of radiant heaters.

For example, in the first set of radiant heaters 120*a–c*, shown as panel A on FIG. 2, the top radiant heater 120*a*, having a top U-tube 308*a*, and middle radiant heater 120*b*, having middle U-tube 308*b*, are rotatably connected to a first blower unit 304 while the bottom radiant heater 120*c*, having bottom U-tube 308*c*, is rotatably connected to a second blower unit 306. Referring to the top U-tube 308*a* of the top radiant heater 308*a*, the exhaust end 312 of the top U-tube 308*a* is secured to a first coupler 316 that fits within, and is rotatable in relation to, a second coupler 314 attached to the first blower unit 304. The use of a rotatable first coupler 316 and second coupler 314 are well known in the relevant arts. It would be readily apparent for one of ordinary skill in the relevant art to use such a first coupler 316 and second coupler 314. Similar to the top U-tube 308*a* of the top radiant heater 120*a*, the middle U-tube 308*b* of the middle radiant heater 120*b* and the bottom U-tube 308*c* of the bottom radiant heater 120*c* are connected to the first blower unit 304 and the second blower unit 306 respectively via a first coupler 316 rotatably connected to a second coupler 314.

The second set of radiant heaters 120*d–f*, shown as panel B on FIG. 2, are similarly attached to a first blower unit 404 and a second blower unit 406 via a first coupler 416*a–c* rotatably connected to a second coupler 414*a–c*.

Also in the preferred embodiment, a back panel 124*a,b* is positioned on each side wall 106, 110 of the oven 100 behind the radiant heaters 120*a–f*. The back panels 124*a,b* are preferably made of stainless steel, and optionally may be painted flat black. The back panels 124*a,b* are used to capture any radiant energy emitted from the radiant heaters 120*a–f* that miss the object 202. The ambient temperature of the oven 100 is maintained via these back panels 124*a,b* with the exhaust fan 132 and the radiant heaters 120*a–f*.

Also in the preferred embodiment, the radiant heaters 120*a–f* discharge their exhaust air through the exhaust fan 132 and out of the oven chamber 102. However, alternatively, the exhaust fan 132 redirects partial exhaust air back into the oven chamber 102, during which negative pressure must be maintained within the oven chamber 102 to ensure proper flow of the exhaust air through the exhaust fan 132 and the distribution of heat throughout the oven chamber 102. This internal routing of partial exhaust air raises the ambient temperature within the oven 100 faster than in conventional curing ovens, resulting in the oven 100 reaching ambient temperatures of 300–500° F. much faster. Furthermore, in the alternative embodiment, the re-entry of the partial exhaust air is preferably through a vent in the bottom 108 of the oven chamber 102 as a means for reducing the amount of dust and/or foreign particles introduced into the oven chamber 102 and as a means for taking advantage of rising hot air in curing/heating the object 202.

In an alternative embodiment, a conventional turbulent fan 602 is mounted to the top wall 104 of the oven 600. The turbulent fan 602 is mounted on the top wall 104 for convenience purpose only. It would be readily apparent to mount the turbulent fan 602 on a different wall of the oven 600. The turbulent fan 602 is used in combination with a means for deflecting the air flow, including an air direction unit 604, to circulate air within the oven chamber 102 of the oven 600, thereby employing convection heat.

An air direction unit 604 is used to divide the circulated air into a first air flow 620 directed to the first side wall 106 of the oven 600 and a second air flow 618 directed to the second side wall 110 of the oven 600. A first deflectors 612 is positioned in proximity to the first side wall 106 to direct the first air flow 620 from the top of the oven chamber 102, down the side wall 106 to the bottom wall 108, then up from the bottom wall 108 toward the object 202 being cured/heated. The first deflector 612 has a first curved portion 614 at one end and a second curved portion 616 at its other end to aid in the deflection of the first air flow 620. Similarly, a second deflector 606 is positioned in proximity to the second side wall 110 to direct the second air flow 618 from the top of the oven chamber 102, down the sidewall 110 to the bottom wall 108, then up from the bottom wall 108 toward the object 202 being cured/heated. The second deflector 606 has a first curved portion 608 at one end and a second curved portion 610 at its other end to aid in the deflection of the second air flow 618. Therefore, the first deflector 612 and the second deflector 606 aim the heated air directly at the object 202 being cured/heated. The turbulent fan 602 is controlled by a variable frequency driver and the computer system 700 for full flow control of airflow within the oven chamber 102.

In the preferred embodiment, one or more types of sensors are placed throughout the oven chamber 102 to assist in regulating the radiant heaters 120*a–f*. For example, a water-cooled object temperature sensor ("object sensor") 126 is positioned within the oven chamber 102 and is directed at the object 202 being cured/heated. In the present invention, the object sensor 126 is pivotally connected on top of a support frame 128 that is vertically adjustable. Therefore, the object sensor 126 can be adjusted to read the temperature of the object 202 at an appropriate spot on the object 202. In another embodiment, the object sensor 126 may be suspended from the top 104 of the oven chamber 102 to monitor the temperature of the object 202 being cured/heated.

The objected sensor 126 is described in terms of a water cooled sensor for convenience purpose only. It would be readily apparent for one of ordinary skill to use a comparable object sensor 126 for determining the temperature of the object 202 as it is being cured/heated. Furthermore, water cooled sensors are well known in the relevant arts and are commercially available. Although the figures only show the use of a single object sensor 126, this too is for convenience only. It would be readily apparent to one of ordinary skill in the relevant art to incorporate a plurality of object sensors 126 to monitor the object's 202 temperature. The temperature readings from all object sensors 126 are input directly into the computer system 700 described below and are used to regulate the radiant heaters 120*a–f* of the oven 100. In addition, the computer system 700 monitors and regulates the water flow to the object sensor 126 to ensure the gradual heating of the water, thereby preventing any fogging of the lens of the object sensor 126. The computer system 700 regulates the water pressure to the object sensor 126 using a variable frequency driver according to well known methods.

In addition, the oven 100 may incorporate zero or more ambient temperature sensors 130 positioned throughout the oven chamber 102. Sensors for monitoring ambient temperature are well known in the relevant art and it would be readily apparent for one of ordinary skill to incorporate one or more such ambient temperature sensors 130 in the oven 100 of the present invention. The temperature readings from all ambient temperature sensors 130 are input directly into the computer system 700 described below and are used to regulate the radiant heaters 120*a–f* of the oven 100.

In the preferred embodiment, the radiant heaters 120*a–f*, the turbulent fan 602, the exhaust fan 132 and the ambient temperature of the oven 100 are electronically controlled via a computer system 700 which is described in more detail below. The computer system 700 is connected to the oven 100, the radiant heaters 120*a–g*, the turbulent fan 602, and exhaust fan 132 via a control box 134 using conventional means. Alternatively, the radiant heaters 120*a–f*, the turbulent fan 602, exhaust fan 132 and ambient temperature can be controlled manually.

In operation, an object 202 is placed centrally within the oven chamber 102 of the oven 100. An operator manually or electronically pivots and rotates the radiant heaters 120*a–f* to ensure that the emitted heat is directed to the appropriate portion(s) of the object 202 to ensure a uniform curing of the object 202. The operator also positions the object sensor 126 to point at the center, or other spot, of the object 202. Based on the composition of the object 202, the operator then programs the radiant heaters 120*a–f* via the control box 134 to specific temperatures and time durations to customize the cure process for the object 202. If the turbulent fan 602 is to be used, then once the gel process of the powder paint on the object 202 occurs, e.g., after a five (5) minute delay, the computer system 700 turns on the turbulent fan 602, forcing the heated air to the bottom 108 of the oven chamber 102 where the deflectors 124*a,b* force the air flow toward the center of the oven chamber 102, resulting in a uniform flow of convection heat transfer to the object 202 being cured.

B. Control of Heating Methods

Figure 7:
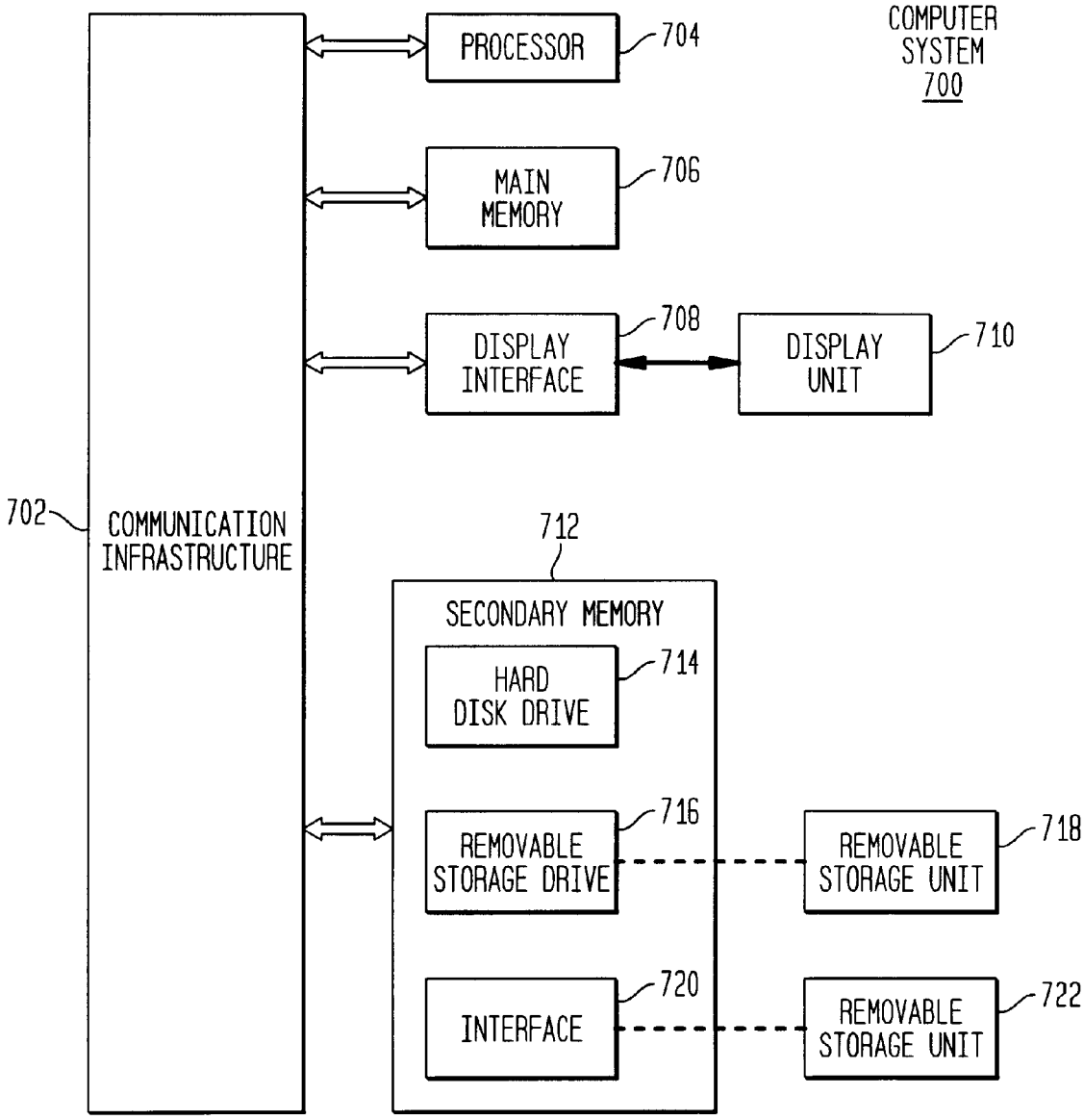
FIG. 7: A block diagram of an exemplary computer system for use with the oven.

FIG. 7 is a block diagram showing an exemplary computer system 700 which can be used with a curing oven 100 of the present invention. The computer system 700 includes one or more processors, such as a processor 704. The processor 704 is connected to a communication infrastructure 702, e.g., a communications bus, cross-over bar, or network. Various software embodiments are described in terms of this exemplary computer system 700. After reading this description, it will become apparent to a person of ordinary skill in the relevant art(s) how to implement the invention using other computer systems and/or computer architectures.

The computer system 700 includes a display interface 708 that forwards graphics, text, and other data from the communications infrastructure 702 (or from a frame buffer not shown) for display on the display unit 710, e.g., a computer screen or monitor on which a graphical user interface, including a window environment, may be displayed. The display interface 708 can also include one or more input peripherals, including, for example, a keyboard, a mouse, a light pen, a pressure-sensitive screen, etc., which provide a user with the capability of entering such input to the computer system 700.

The computer system 700 also includes a main memory 706, preferably random access memory (RAM), and may also include a secondary memory 712. The secondary memory 712 may o include, for example, a hard disk drive 714 and/or a removable storage drive 716, representing a floppy disk drive, a magnetic tape drive, an optical disk, a compact disk drive, etc. which is read by and written to by a removable storage unit 718. The removable storage unit 718, also called a program storage device or a computer program product, represents a floppy disk, magnetic tape, optical disk, compact disk, etc. As will be appreciated, the removable storage unit 718 includes a computer usable storage medium having stored therein computer software and/or data. The removable storage drive 716 reads from and/or writes to a removable storage unit 718 in a well known manner.

In alternative embodiments, secondary memory 712 may also include other similar means for allowing computer programs or other instructions to be loaded into the computer system 700. Such means may include, for example, an interface 720 and a removable storage unit 722. Examples of an interface 720 may include a program cartridge and cartridge interface (such as that found in video game devices), a removable memory chip (such as EPROM, or PROM) and associated socket, and other removable storage units 722 and interfaces 720 which allow software and data to be transferred from the removable storage unit 722 to the computer system 700.

In this document, the term "computer program medium" and "computer usable medium" are used to generally refer to media such as removable storage unit 718, 722, a hard disk installed in hard disk drive 714. These "computer program products" are means for providing software to a computer system 700. Portions of the present invention are directed to such computer program products. It would be readily apparent for one of ordinary skill in the relevant art to design and implement the described software for controlling the radiant heaters 120*a–f* and turbulent fan 602 of the curing oven 100.

Computer programs (also called computer control logic) are stored in main memory 706 and/or secondary memory 712. Such computer programs, when executed, enable the computer system 700 to perform the features of the present invention as discussed herein. In particular, the computer programs, when executed, enable the processor 704 to perform the features of the present invention. Accordingly, such computer programs represent controllers of the computer system 700.

In an embodiment where portions of the invention are implemented using software, the software may be stored in a computer program product and loaded into computer system 700 using removable storage drive 716 or a hard disk drive 714. The software, when executed by the processor 704, causes the processor 704 to perform the functions of the invention as described herein.

In another embodiment, the invention is implemented primarily in hardware using, for example, a hardware state machine, such as application specific integrated circuits (ASICS). Implementation of the hardware state machine so as to perform the functions described herein will be apparent to persons skilled in the relevant arts.

In yet another embodiment, the invention is implemented using a combination of hardware and software.

The preferred computer system 700 is a SLC500 which is commercially available. The SLC500 is used for convenience purpose only, the present invention also can be developed on any appropriate computer system, e.g., a personal computer, sun workstation or mainframe computer. The present invention is described in terms of a computer system 700 having a single processor 704 for convenience purposes only. It would be readily apparent, however, to one skilled in the relevant arts to use a computer system 700 having multiple processors 704, thereby executing the present invention in parallel. The preferred embodiment of the present invention is implemented in software, and more specifically, is written in the programming language RSLogix 500, version 2.5, available from Rockwell Software. The preferred embodiment is described in these terms for convenience purpose only. Other comparable computer systems 700 and programming languages could alternatively be used.

Figure 8:
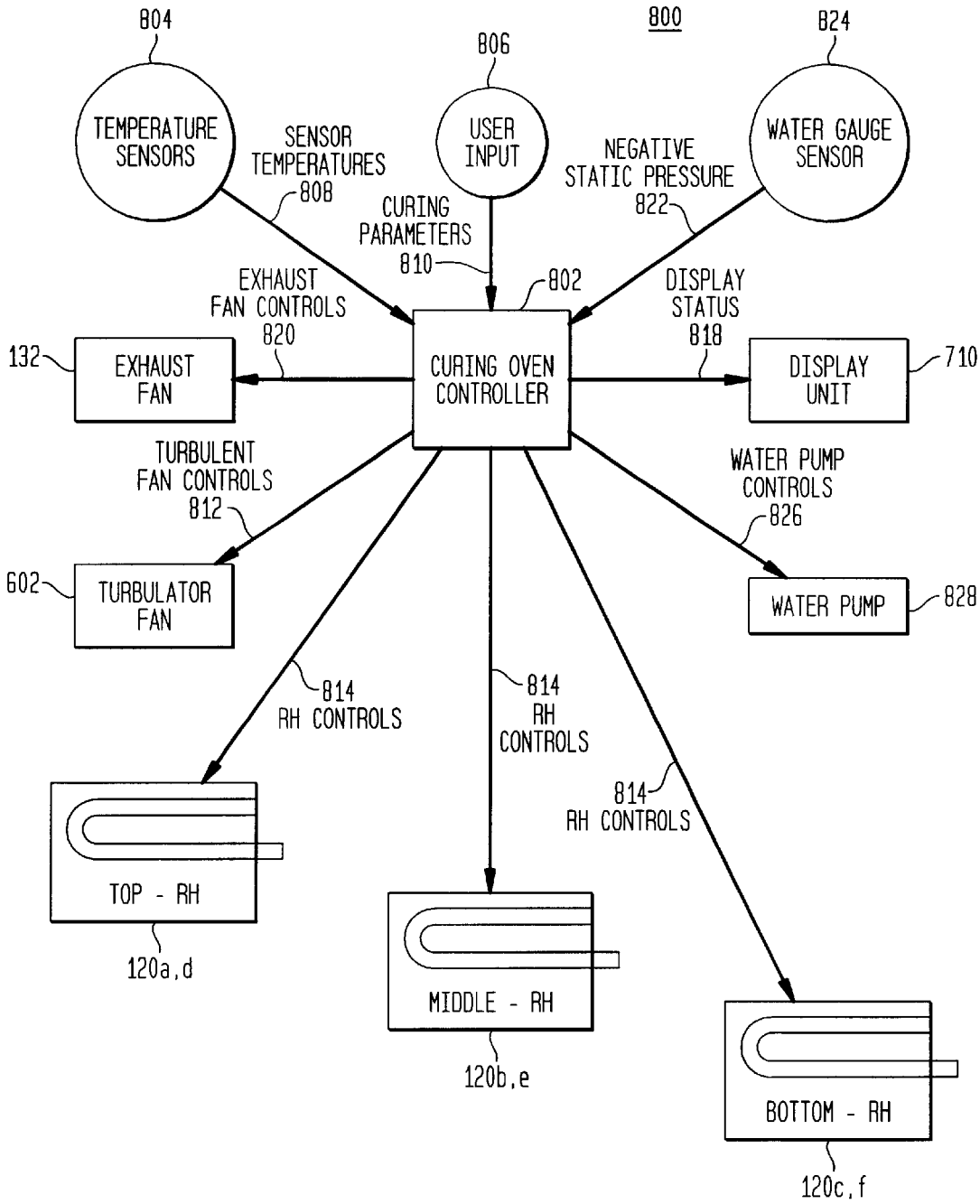
FIG. 8: A data flow diagram showing the operation of the oven controller software of the present invention.

FIG. 8 is a data flow diagram showing the operational flow of the process of curing an object 202 using an oven 100 of the present invention. The curing oven controller 802 is a software program executing within the computer system 700 of the control box 134. The curing oven controller 802 receives input from temperature sensors 804, user input 806, and a water gauge sensor 824. The temperature sensors 804 comprise one or more object sensors 126 as well as zero or more ambient temperature sensors 130, wherein both types of sensors send sensor temperatures 808 to the curing oven controller 802. The user input 806 comprises various curing parameters 810 used to control and maintain the curing process within the curing oven 100. The curing parameters 810 include, but are not limited to, a preset time for setting the cure time of the object 202, a preset temp for setting the cure temperature of the object 202, a maximum ambient temperature for the oven chamber 102, a maximum temperature for the top radiant heaters 120*a,d*, a maximum temperature for the middle radiant heaters 120*b,e*, and a maximum temperature for the bottom radiant heaters 120*c,f*. The water gauge sensor 824 provides a negative static pressure 822 to the curing oven controller 802 for use in controlling the exhaust fan 132.

Once the curing oven controller 802 receives these curing parameters 810, the curing oven controller 802 controls the radiant heaters 120*a–f* via radiant heater (RH) controls 814, the exhaust fan 132 via exhaust fan controls 820, the water pump 828 via water pump controls 826, and optionally controls the turbulent fan 602 via turbulent fan controls 812. The curing oven controller 802 sends display status 818 data to the display unit 710 as a means for informing the operator of the status of the curing process.

Figure 9:
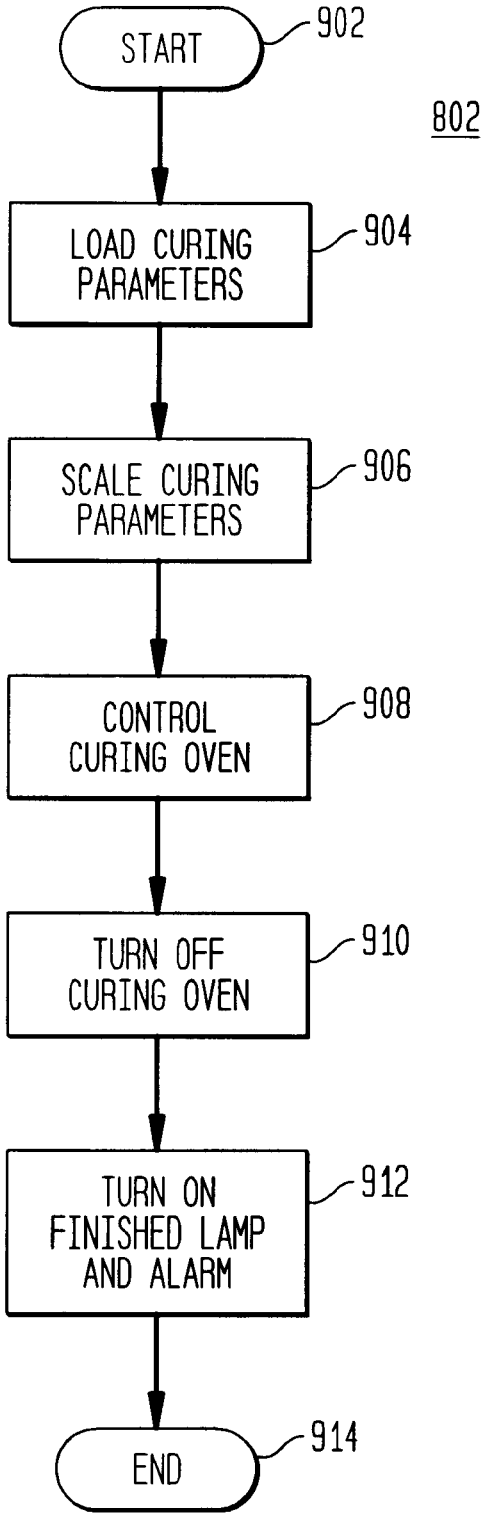
FIG. 9: A control flow diagram showing the main operation of the curing oven controller software.

FIG. 9 provides an operational control flow for the processing of the curing oven controller 802. Processing begins at step 902 and immediately continues to step 904. In step 904, the curing oven controller 802 loads the curing parameters 810. Continuing to step 906, the curing oven controller 802 scales the curing parameters 810 according to standard scaling principals. Once the scaling is complete, the curing oven controller 802 continues to step 908 in which the curing oven controller 802 controls the curing oven 100. The operation of step 908 is described in greater detail below. After completing the curing of the object 202, the curing oven controller 802 proceeds to step 910 wherein it turns off the curing oven 100, including the radiant heaters 120*a–f*, the exhaust fan 132, and the turbulent fan 602 if used. All processing is complete, thereby the curing oven controller 802 continues to step 912 in which it turns on a finished lamp signal on the control box 132 and an audible alarm, signaling the completion of the curing process within the oven 100. Processing is terminated at step 914.

Figure 10:
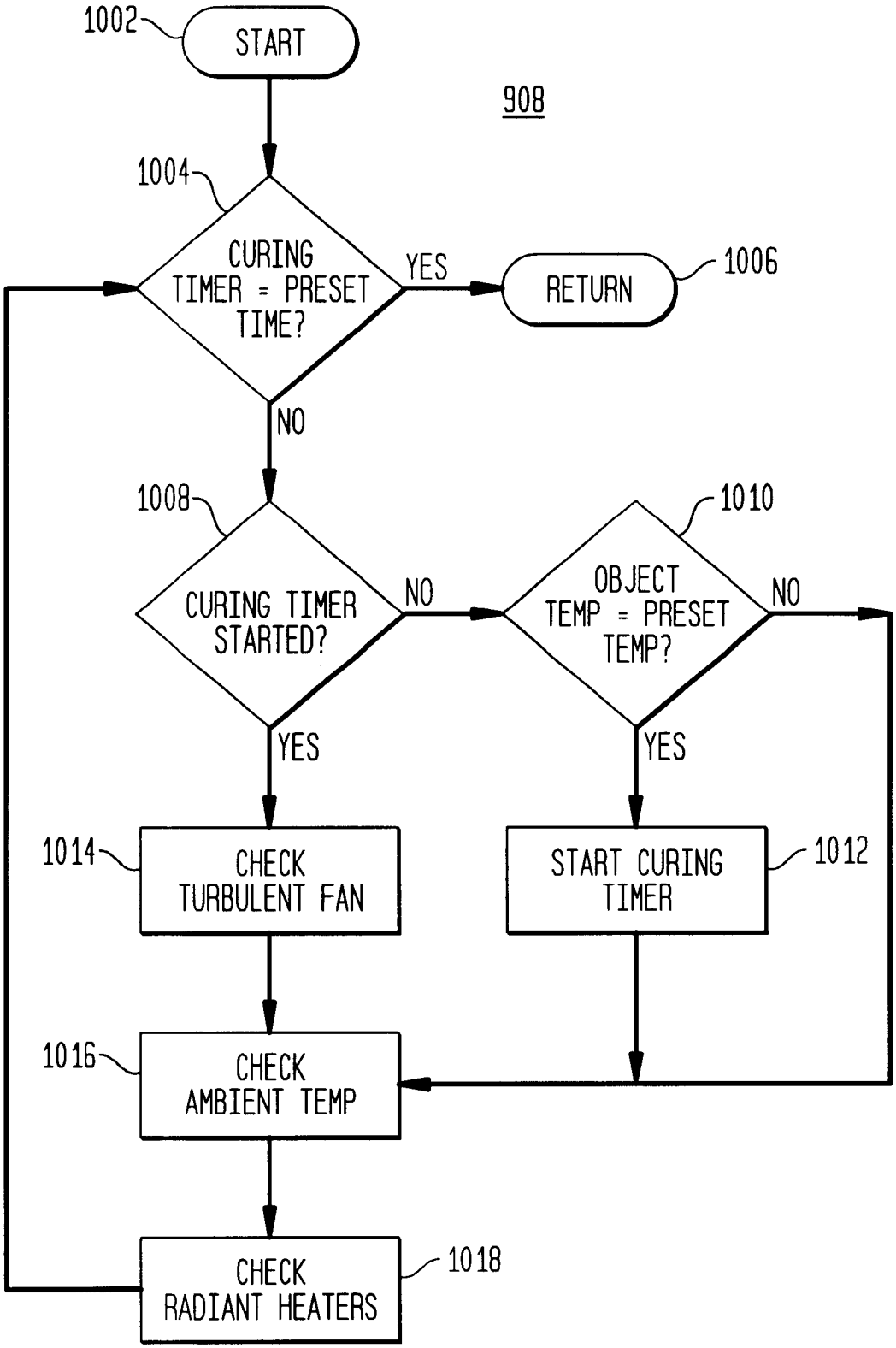
FIG. 10: A control flow diagram showing the operation of the Control Curing Oven software.

Referring again to step 908, the processing of the control of the curing oven 100 is shown on FIG. 10. Processing begins at step 1002 and immediately proceeds to step 1004. In step 1004, the curing oven controller 802 determines whether the curing timer (a timer used to calculate the actual cure time of the object 202) has reached the preset time entered by the operator. If the curing timer does not equal the preset time, processing proceeds to step 1008.

In step 1008, the curing oven controller 802 determines whether the curing timer has even been activated or started. If the curing timer has not been started, processing proceeds to step 1010 wherein the curing oven controller 802 determines whether the object temperature via the objected sensor 126 is equal to the preset temp entered by the operator. If the object temperature equals the preset temp, then the curing stage has begun and the curing timer must be started. Processing proceeds to step 1012 wherein the curing timer is started. Processing continues to step 1016 described in greater detail below.

Referring against to step 1010, if the object temperature does not equal the preset temp, then the curing stage has not begun and processing proceeds directly to step 1016 described in greater detail below.

Referring back to step 1008, if the curing oven controller 802 determines that the curing timer has already started then the object 202 is in the curing stage and curing oven controller 802 proceeds to step 1014.

In step 1014, the curing oven controller 802 checks the turbulent fan 602 and controls when it is turned on and off. Step 1014 is described in greater detail below. After checking the turbulent fan 602, processing continues to step 1016. In step 1016, the curing oven controller 802 checks the ambient temperature within the oven chamber 102. Step 1016 is described in greater detail below. Once the ambient temperature is regulated, the curing oven controller 802 continues to step 1018 to check the radiant heaters 120*a–f* and regulate their activity. Step 1018 is also described in greater detail below.

Once the temperature of the object 202 has been controlled and regulated, the curing oven controller 802 returns to step 1004 to determine whether the curing stage of the object 202 is complete. If the curing timer equals the preset time, the curing oven controller 802 proceeds to step 1006 wherein processing is returned to step 908 and continues immediately to step 910.

Figure 11:
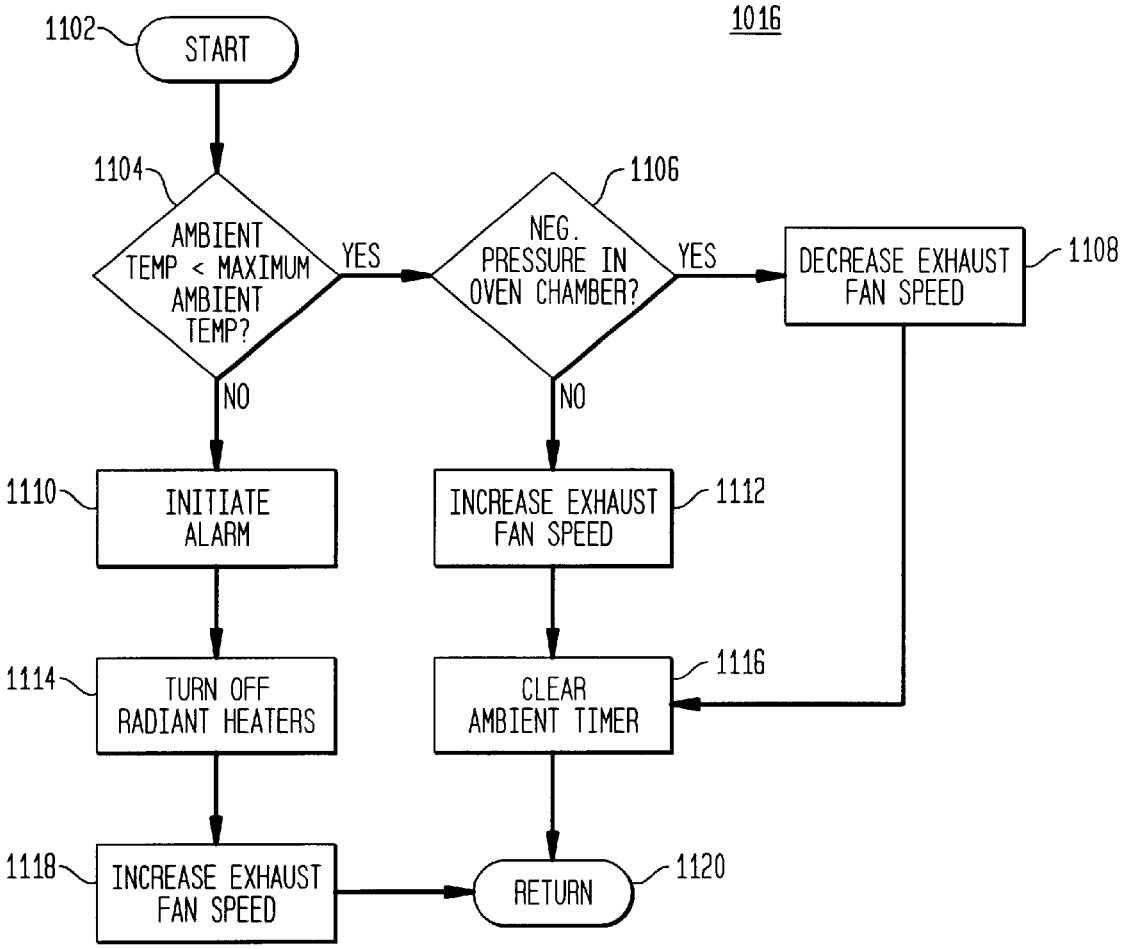
FIG. 11: A control flow diagram showing the operation of the Check Ambient Temp software.

FIG. 11 is the operational flow of step 1016 wherein the curing oven controller 802 checks and regulates the ambient temperature within the oven chamber 102. Processing begins at step 1102 and immediately continues to step 1104. In step 1104, the curing oven controller 802 determines whether the ambient temperature in the oven chamber 102, as received via an ambient temperature sensor 130, is less than a maximum ambient temperature. In the preferred embodiment, the maximum ambient temperature is input to the computer system 700 via the curing parameters 810. If the ambient temperature is greater than or equal to the maximum, processing continues to step 1110.

In step 1110, the curing oven controller 802 initiates an alarm, visual and/or audible, because the ambient temperature within the oven chamber 102 is too hot. Continuing to step 1114, which is described in greater detail below, the curing oven controller 802 turns off the radiant heaters 120*a–f* before moving to step 1118. The curing oven controller 802 also can electronically pivot the radiant heaters 120*a–f* such that any residual radiant heat emitted from the radiant heaters 120*a–f* are now directed away from the object 202.

In step 1118, the curing oven controller 802 increases the speed of the exhaust fan 132 as a means for quickly removing heat from within the oven chamber 132. Processing continues to step 1120 wherein the curing oven controller 802 returns processing to step 1016 and it continues immediately to step 1018.

Referring again to step 1104, if the ambient temperature is less than the maximum ambient temperature, processing proceeds to step 1106. In step 1106, the curing oven controller 802 determines whether there is a negative static pressure 822 within the oven chamber 102. If there is, processing proceeds to step 1108. In step 1108, the curing oven controller 802 decreases the speed of the exhaust fan 132 to maintain a stable heat environment within the oven chamber 102. Processing continues to step 1116 wherein the curing oven controller 802 clears the ambient timer before proceeding to step 1120. In step 1120, the curing oven controller 802 returns processing to step 1016 wherein it continues immediately to step 1018.

Referring again to step 1106, if the curing oven controller 802 determines that there is not a negative static pressure 822 within the oven chamber 102, processing proceeds to step 1112. In step 1112, the curing oven controller 802 increases the speed of the exhaust fan 132 to lower the temperature within the oven chamber 102. Processing continues to step 1116 wherein the curing oven controller 802 clears the ambient timer before proceeding to step 1120. In step 1120, the curing oven controller 802 returns processing to step 1016 wherein it continues immediately to step 1018.

Figure 12:
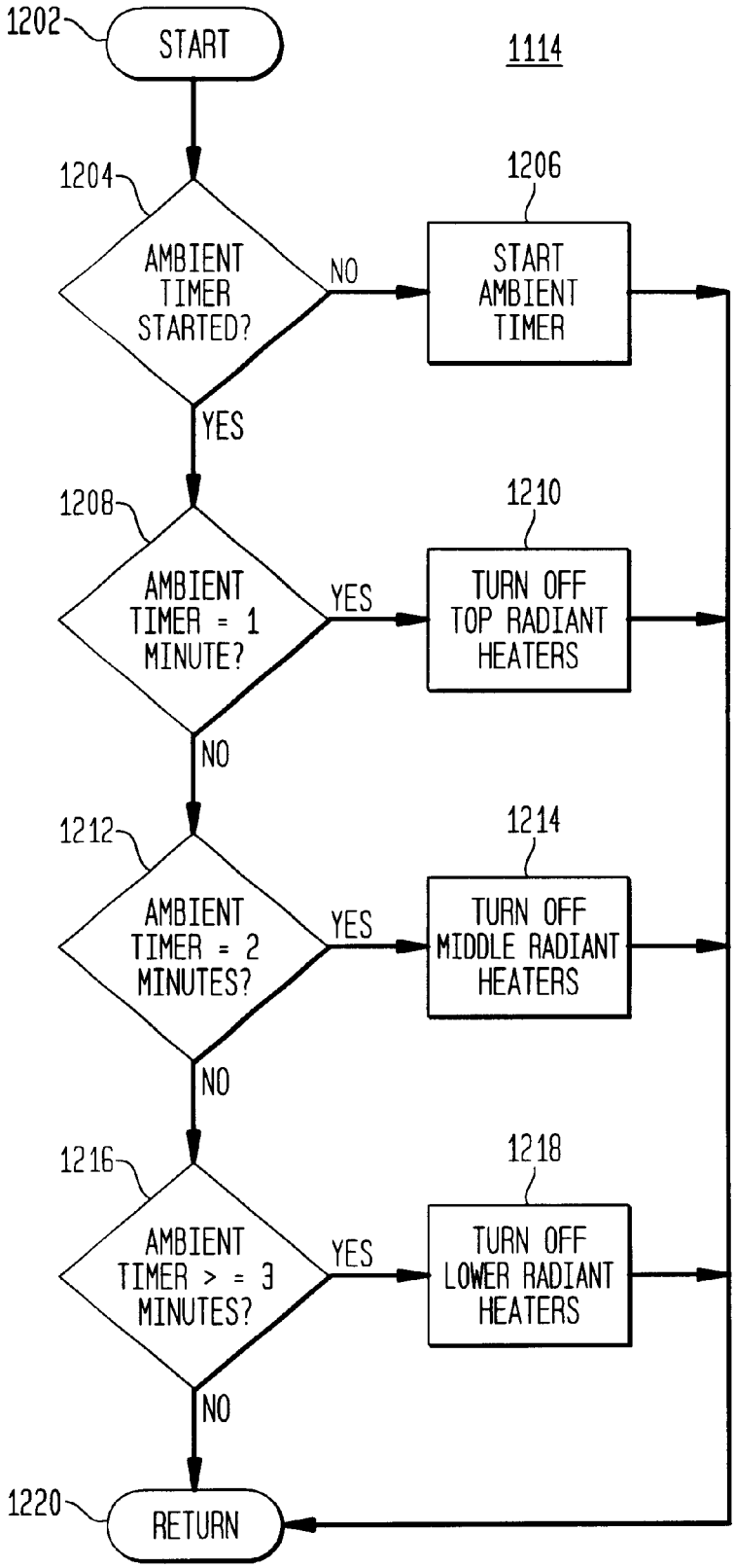
FIG. 12: A control flow diagram showing the operation of the Turn Off Radiant Heaters software.

FIG. 12 is an operational diagram showing the processing of step 1114. In step 1114, processing begins at step 1202 and proceeds immediately to step 1204. In step 1204, the curing oven controller 802 determines whether the ambient timer has been started. If the ambient timer has not been started then processing continues to step 1206. In step 1206, the ambient temperature in the oven chamber 102 is too hot, therefore, the curing oven controller 802 starts the ambient timer to calculate the duration of time that the ambient temperature is too high. Once the timer is started, processing proceeds to step 1220 wherein processing returns to step 1114.

Referring again to step 1204, if the ambient timer has not been started, the curing oven controller 802 continues to step 1208. In step 1208, the curing oven controller 802 determines weather the ambient timer has been active for 1 minute. If the time has been so active, the curing oven controller 802 continues to step 1210 wherein it turns off the top radiant heaters 120*a,d*. The curing oven controller 802 may also pivot the top radiant heaters 120*a,d* away from the object 202 such that any residual radiant heat emitted from the top radiant heaters 120*a,d* is directed away from the object 202, thereby lowering the object 202 temperature. Once the top radiant heaters 120*a,d* have been turned off, processing proceeds to step 1220 and returns to step 1114.

Referring again to step 1208, if the ambient timer has not been active for 1 minute, the curing oven controller 802 continues to step 1212. In step 1212, the curing oven controller 802 determines weather the ambient timer has been active for 2 minutes. If the timer has been so active, the curing oven controller 802 continues to step 1214 wherein it turns off the middle radiant heaters 120*b,e*. The curing oven controller 802 may also pivot the middle radiant heaters 120*b,e* away from the object 202 such that any residual radiant heat emitted from the middle radiant heaters 120*b,e* is directed away from the object 202, thereby lowering the object 202 temperature. Once the middle radiant heaters 120*b,e* have been turned off, processing proceeds to step 1220 and returns to step 1114.

Referring again to step 1212, if the ambient timer has not been active for 2 minutes, the curing oven controller 802 continues to step 1216. In step 1216, the curing oven controller 802 determines weather the ambient timer has been active for 3 minutes or more. If the timer has been so active, the curing oven controller 802 continues to step 1218 wherein it turns off the bottom radiant heaters 120*c,f*. The curing oven controller 802 may also pivot the bottom radiant heaters 120*c,f* away from the object 202 such that any residual radiant heat emitted from the bottom radiant heaters 120*c,f* is directed away from the object 202, thereby lowering the object 202 temperature. Once the bottom radiant heaters 120*c,f* have been turned off, processing proceeds to step 1220 and returns to step 1114.

Referring again to step 1216, if the ambient timer has not been active for 3 minutes or more, the curing oven controller 802 continues to step 1220 because it has already turned off all of the radiant heaters 120*a–f* and returns to step 1114.

Figure 13:
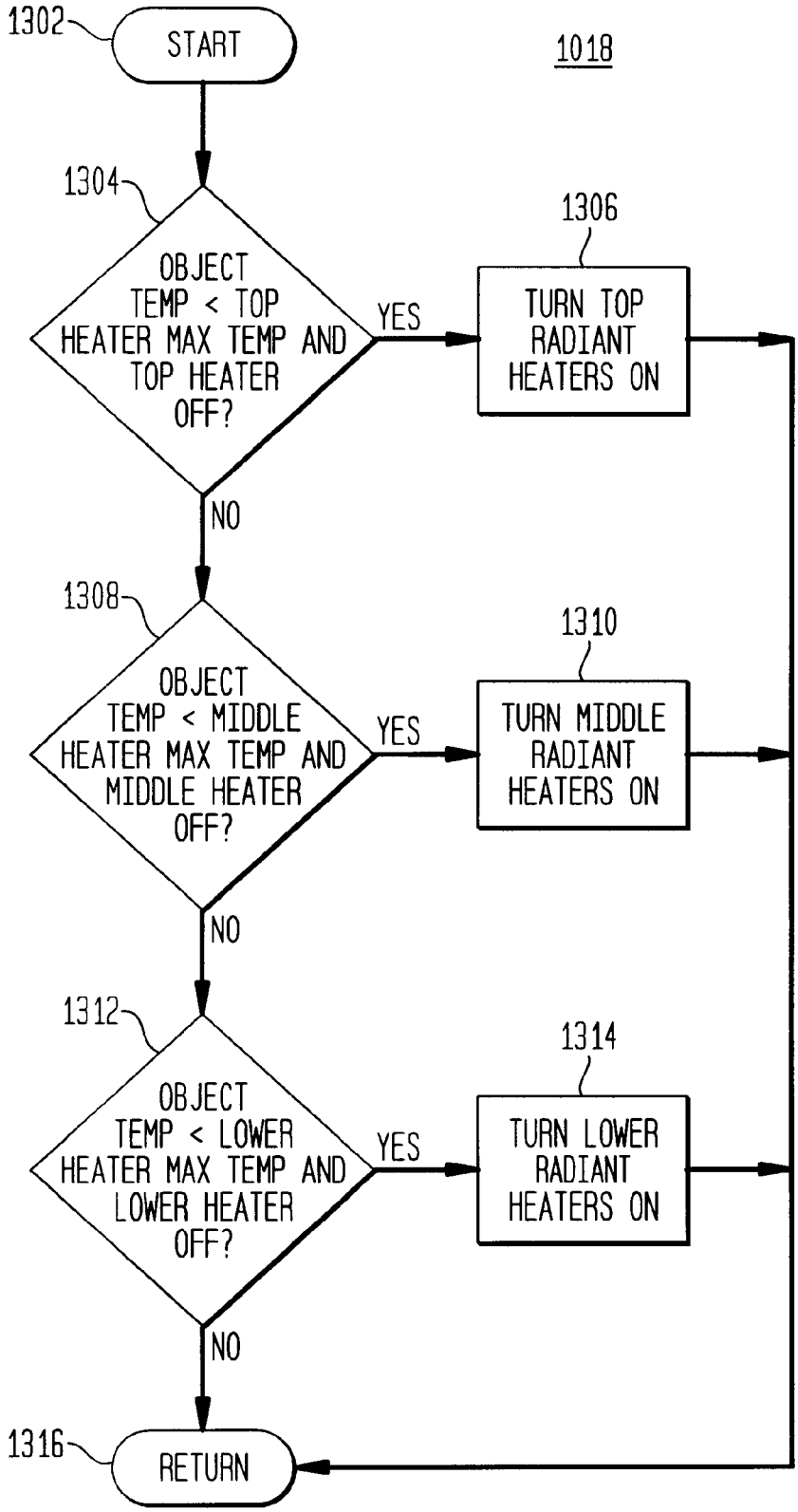
FIG. 13: A control flow diagram showing the operation of the Check Radiant Heaters software.

FIG. 13 shows the operational flow of step 1016 for checking the radiant heaters 120*a–f*. Processing begins at step 1302 and proceeds immediately to step 1304. In step 1304, the curing oven controller 802 determines whether the object temperature is less than the top radiant heater maximum temperature and whether the top radiant heaters 120*a,d* are turned off. If so, the curing oven controller 802 proceeds to step 1306 wherein it turns the top radiant heaters 120*a,d* on. Processing continues to step 1316 wherein processing returns to step 1016.

Referring again to step 1304, if the curing oven controller 802 determines that the object temperature is not less than the top radiant heater maximum temperature or the top radiant heaters 120*a,d* are already turned off, the curing oven controller 802 proceeds to step 1308. In step 1308, the curing oven controller 802 determines whether the object temperature is less than the middle radiant heater maximum temperature and whether the middle radiant heaters 120*b,e* are turned off. If so, the curing oven controller 802 proceeds to step 1310 wherein it turns the middle radiant heaters 120*b,e* on. Processing continues to step 1316 wherein processing returns to step 1016.

Referring again to step 1308, if the curing oven controller 802 determines that the object temperature is not less than the middle radiant heater maximum temperature or the middle radiant heaters 120*b,e* are already turned off, the curing oven controller 802 proceeds to step 1312. In step 1312, the curing oven controller 802 determines whether the object temperature is less than the bottom radiant heater maximum temperature and whether the bottom radiant heaters 120*c,f* are turned off. If so, the curing oven controller 802 proceeds to step 1314 wherein it turns the bottom radiant heaters 120*c,f* on. Processing continues to step 1316 wherein processing returns to step 1016.

Referring again to step 1312, if the curing oven controller 802 determines that the object temperature is not less than the bottom radiant heater maximum temperature or the bottom radiant heaters 120*c,f* are already turned off, the curing oven controller 802 proceeds to step 1316 wherein processing returns to step 1016.

Figure 14:
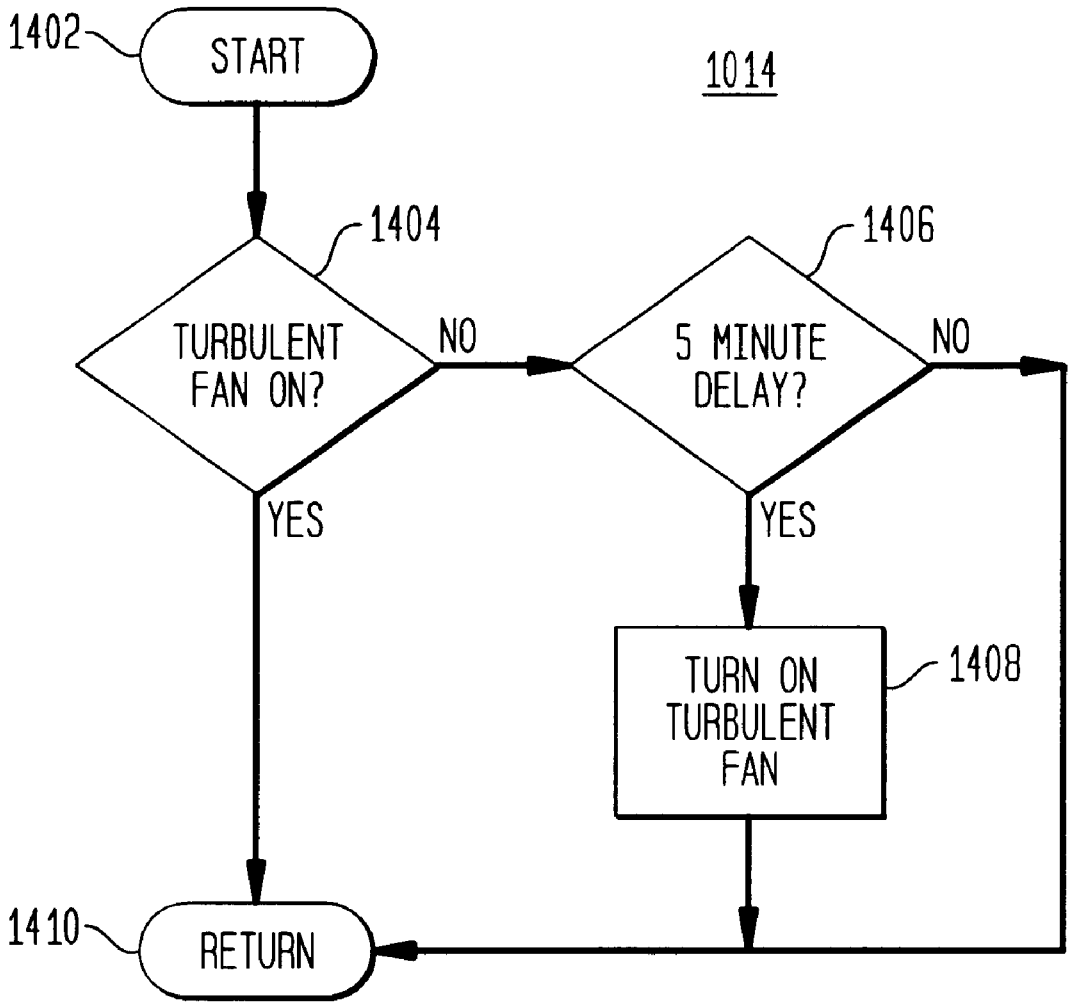
FIG. 14: A control flow diagram showing the operation of the Check Turbulent Fan software.

FIG. 14 is an operational diagram showing the processing of step 1014 wherein the curing oven controller 802 checks the turbulent fan 602. Processing begins at step 1402 and immediately proceeds to step 1404. In step 1404, the curing oven controller 802 determines whether the turbulent fan 602 is on. If the turbulent fan 602 is on, processing proceeds to step 1410 wherein control is returned to step 1014 and immediate continues to step 1016.

Referring again to step 1404, if the curing oven controller 802 determines that turbulent fan 602 is off, processing proceeds to step 1406. In step 1406, the curing oven controller 802 determines whether a time delay, e.g., five minutes which is enough time for the gel process of powder based paint curing to occur, has elapsed. If the delay has occurred, processing proceeds to step 1408 wherein the curing oven controller 802 turns on the turbulent fan 602. Continuing to step 1410, processing returns to step 1014 wherein it immediately continues to step 1016.

Referring again to step 1406, if the curing oven controller 802 determines that the time delay has not occurred, processing proceeds to step 1410, wherein it returns to step 1014 and immediately continues to step 1016.

Figure 15:
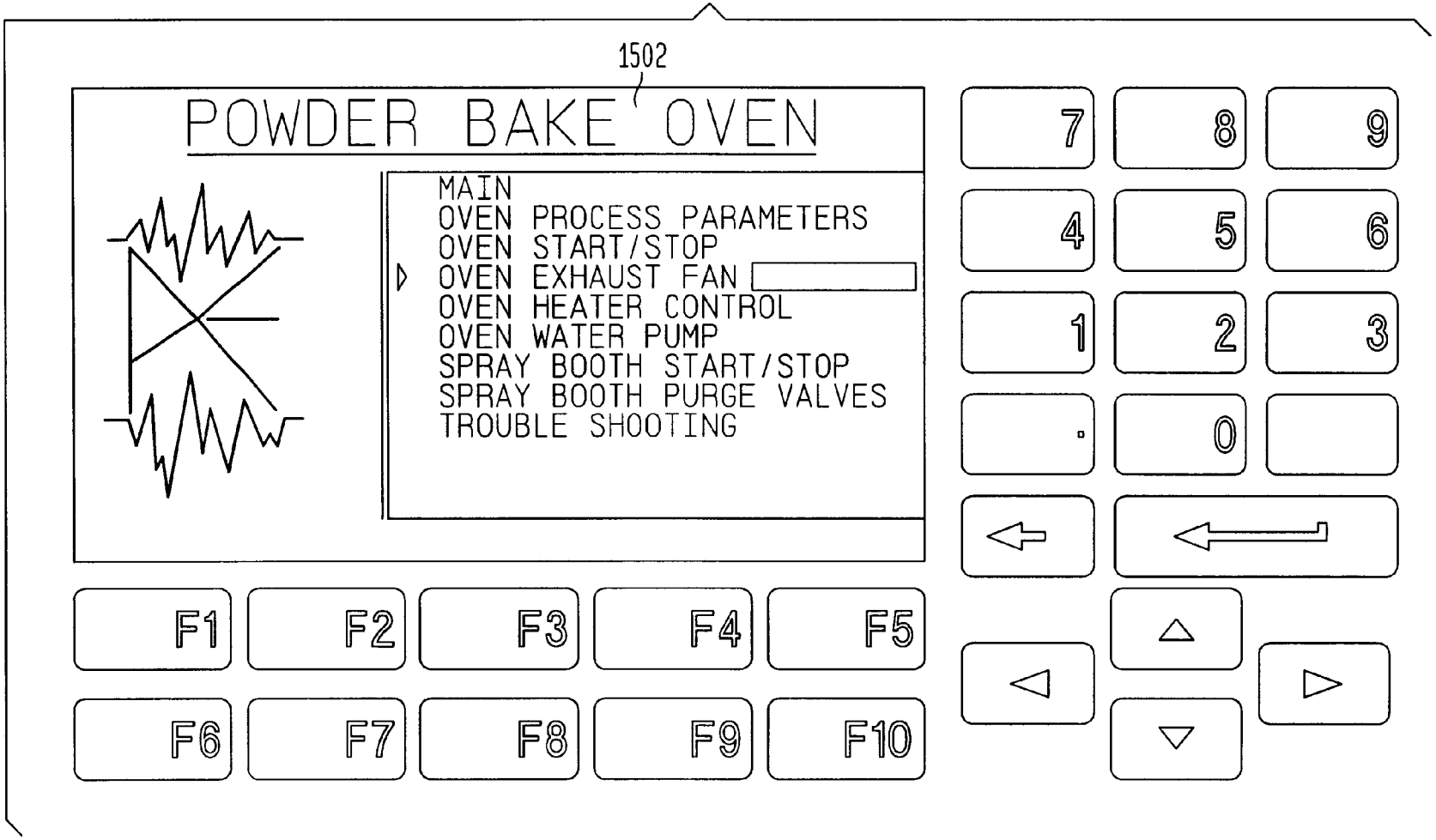
FIG. 15: A block diagram showing the main screen of the user interface for the Curing Oven Controller software.
Figure 16:
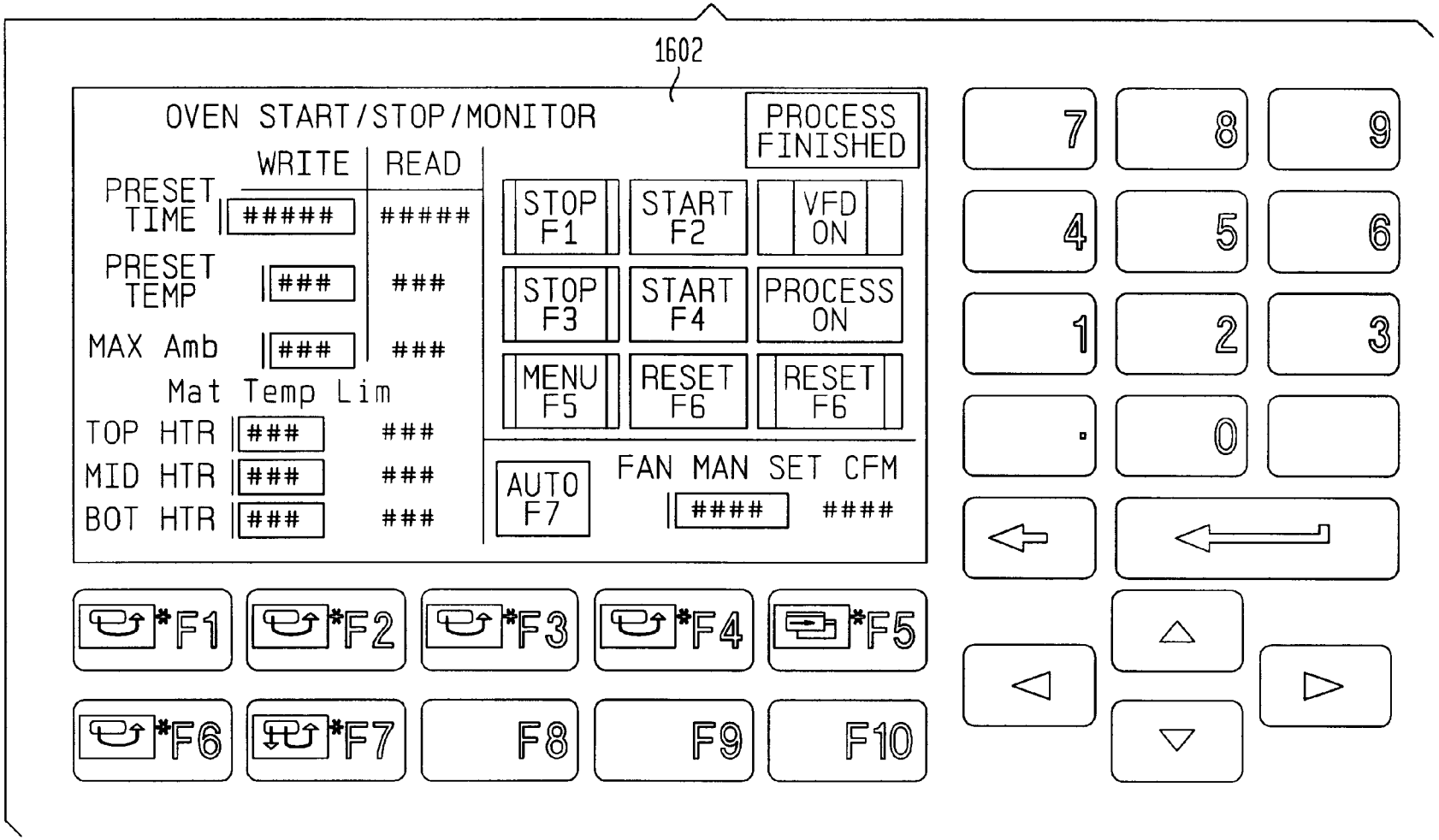
FIG. 16: A block diagram showing the display screen of the user interface for the Oven Start/Stop/Monitor process.
Figure 17:
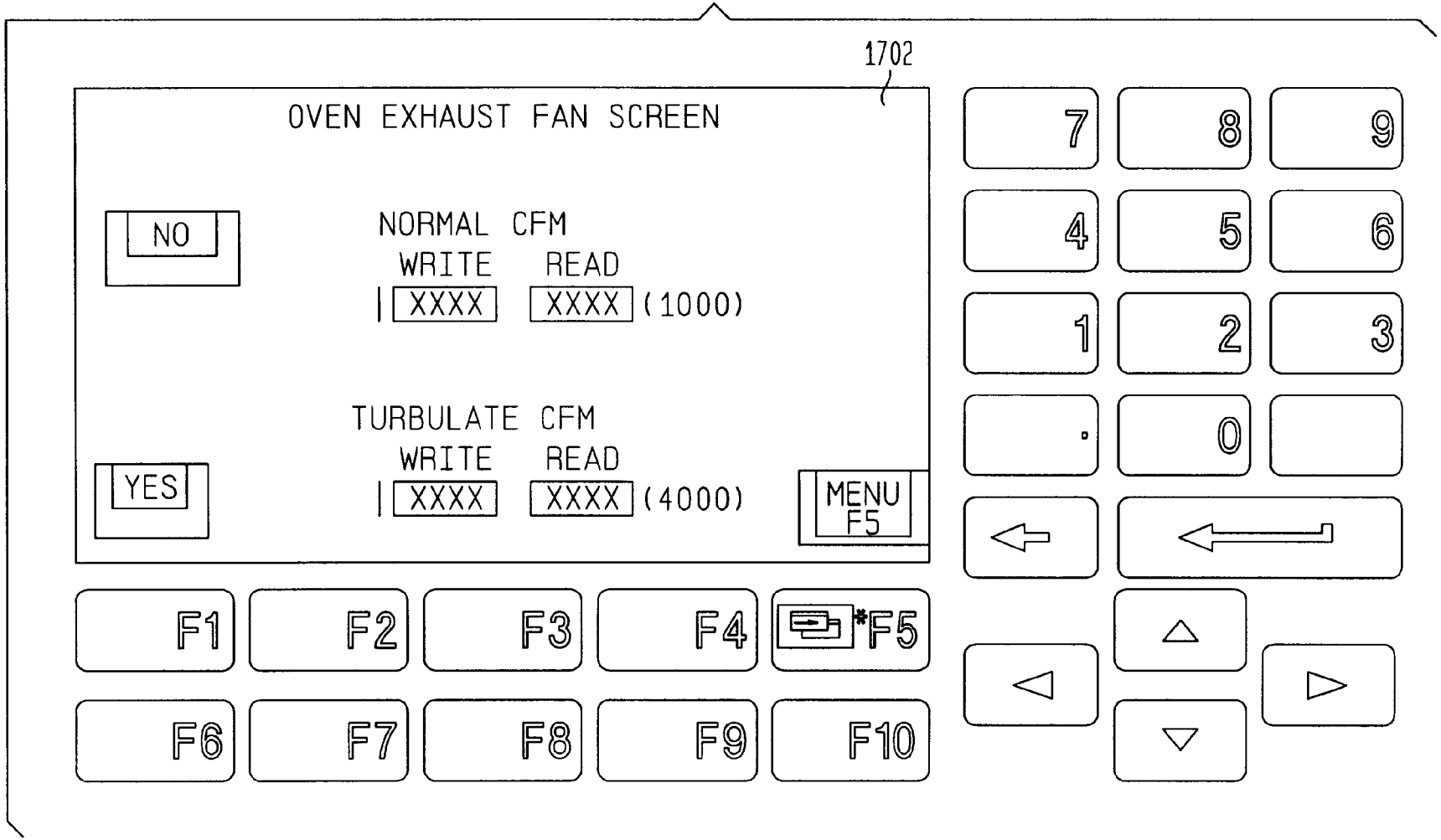
FIG. 17: A block diagram showing the display screen of the user interface for the Oven Exhaust Fan process.
Figure 18:
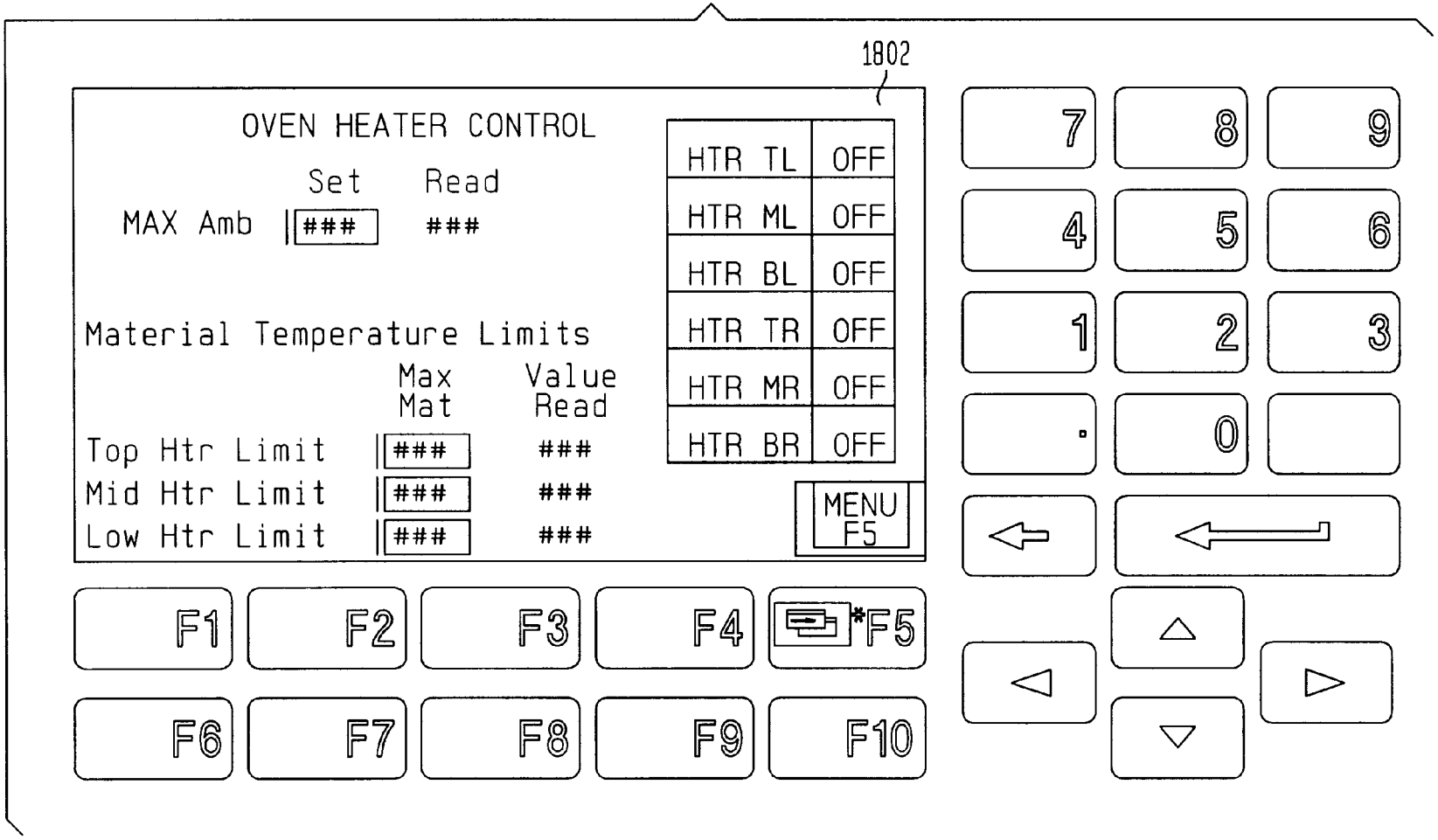
FIG. 18: A block diagram showing the display screen of the user interface for the Oven Heater Control process.
Figure 19:
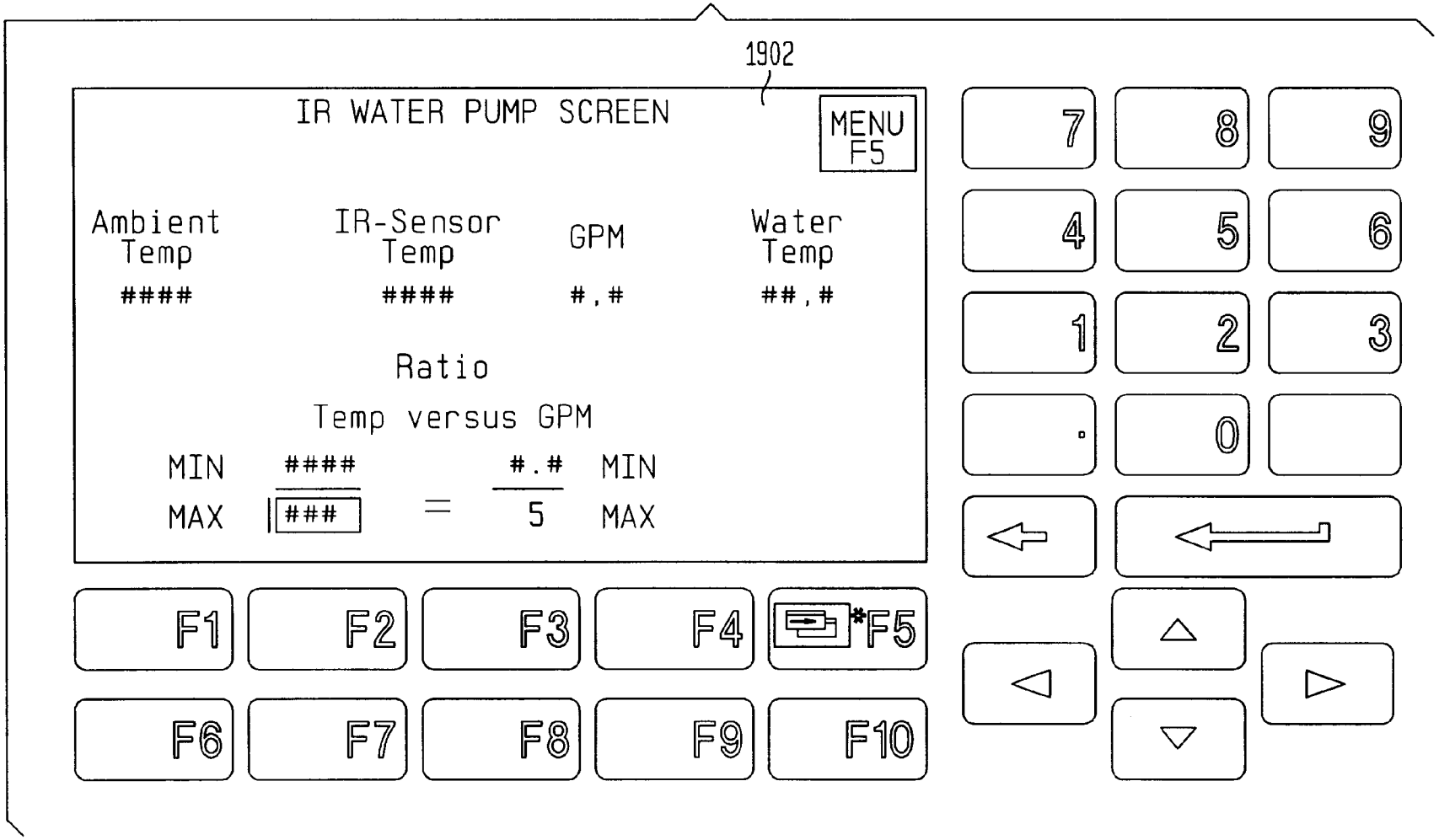
FIG. 19: A block diagram showing the display screen of the user interface for the Infrared Water Pump Sensor process.
Figure 20:
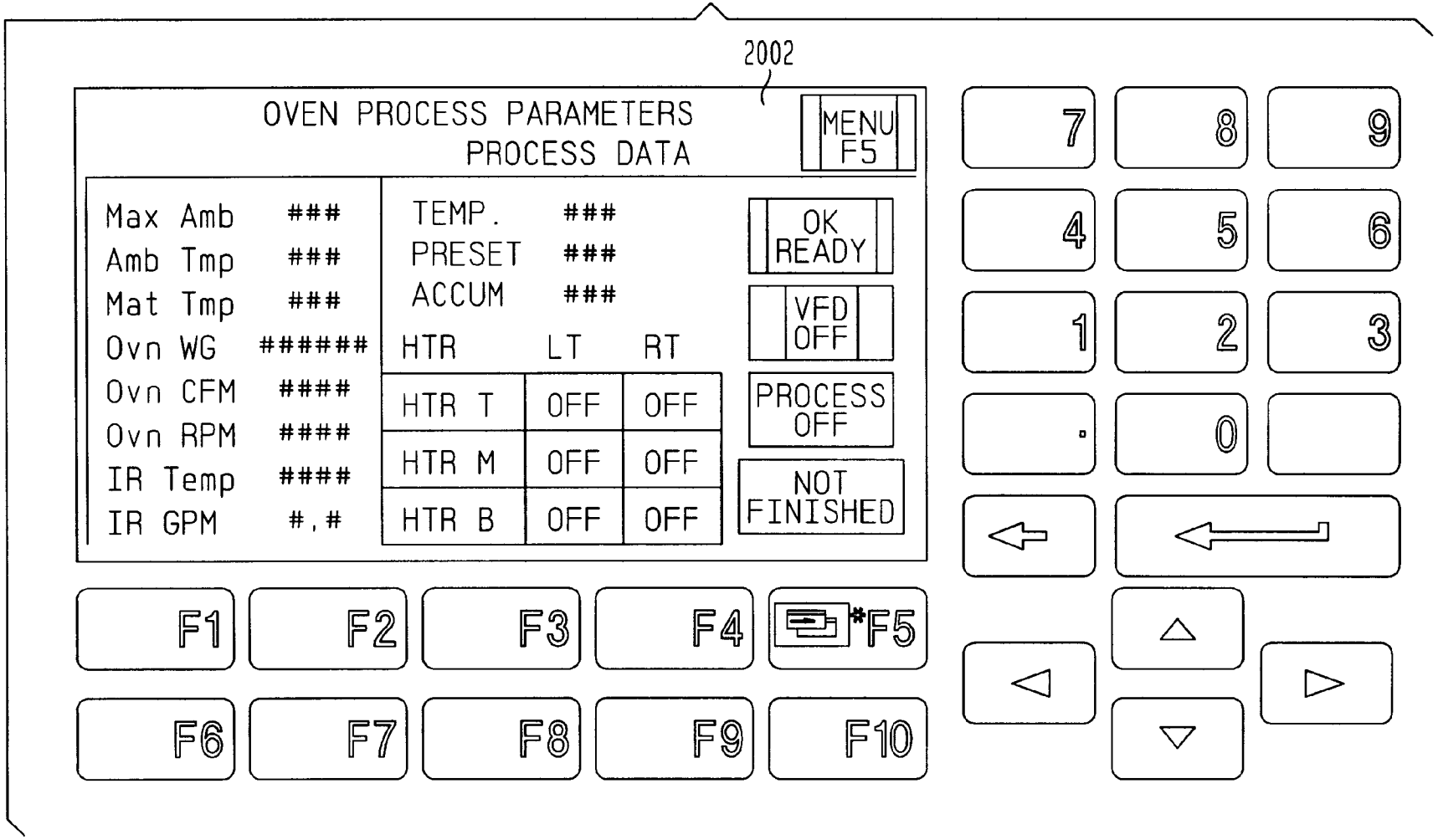
FIG. 20: A block diagram showing the display screen of the user interface for the Oven Process Parameters.

FIGS. 15–20 illustrate the preferred embodiment of user screens used in connection with the curing oven controller 802 as displayed on the controller box 130. FIG. 15 shows the main screen 1502 of the user interface for the Curing Oven Controller 802. FIG. 16 shows the display screen of the user interface for the Oven Start/Stop/Monitor process 1602. FIG. 17 shows the display screen of the user interface for the Oven Exhaust Fan process 1702. FIG. 18 shows the display screen of the user interface for the Oven Heater Control process 1802. FIG. 19 shows the display screen of the user interface for the Infrared Water Pump Sensor process 1902. FIG. 20 shows the display screen of the user interface for the Oven Process Parameters 2002.

II Test Results

Test results using the curing oven 100 of the present invention are shown in FIGS. 21–24. The tests show the cure time for an object 202 comprised of 14 gauge steel using a curing oven 100 of the present invention.

A. Test 1

The following curing parameters 810 were used for Test 1:

| | | |
|---|---|---|
| preheat data | = | 400° F. for 16 minutes |
| preset time | = | 30 minutes |
| preset temp | = | 400° F. |
| max ambient | = | 450° F. |
| top heater max | = | 375° F. |
| middle heater max | = | 400° F. |
| bottom heater max | = | 425° F. |

Figure 21:
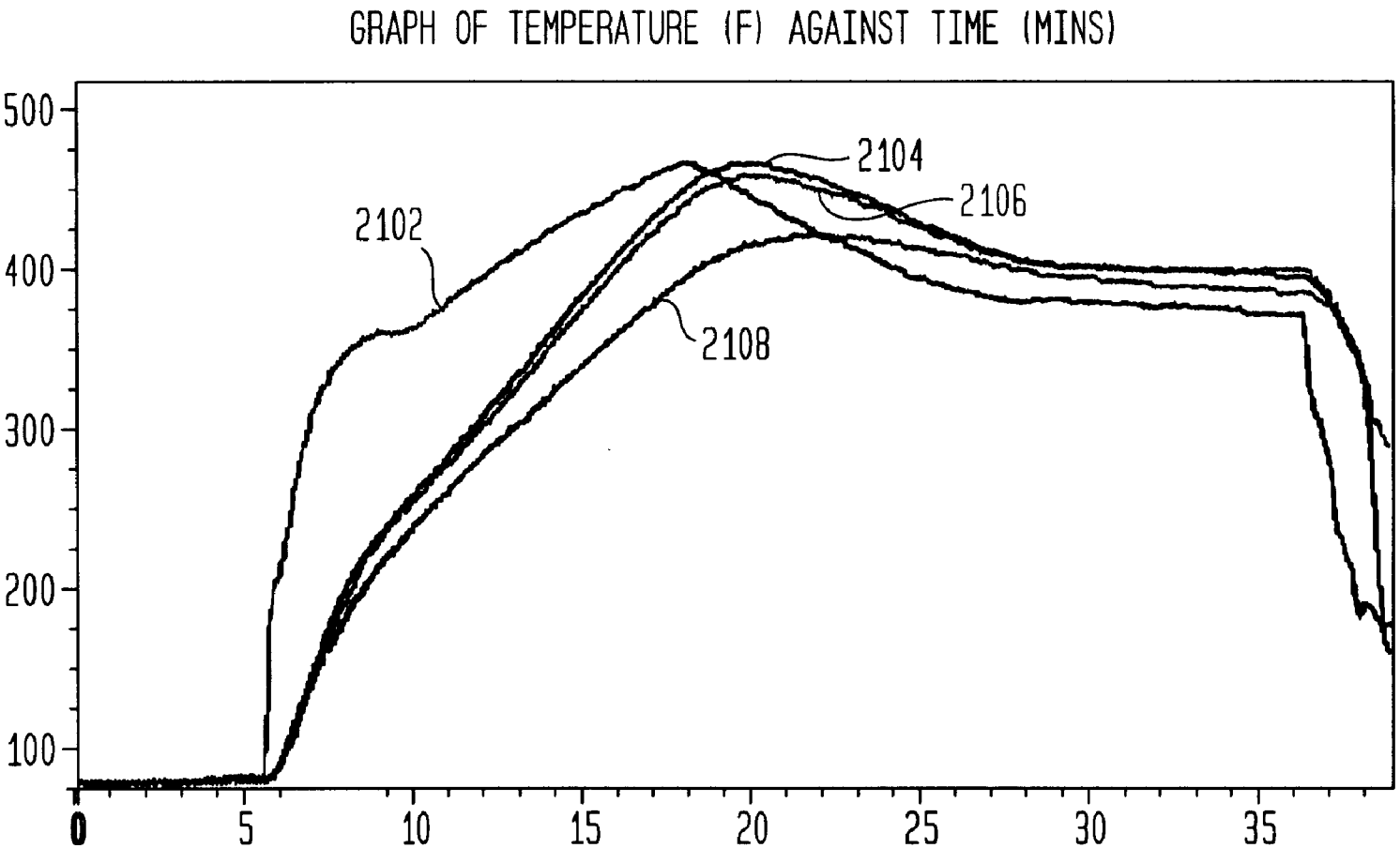
FIG. 21: A graphical representation of results for Test 1 using the oven of the present invention.

The elements on FIG. 21 are:

Element 2102=top air temperature—first top sensor (peak temp=473)

Element 2104=side one of oven chamber (peak temp=466)

Element 2106=side two of oven chamber (peak temp=473)

Element 2108=top air temperature—second top sensor (peak temp=428)

B. Test 2

The following curing parameters 810 were used for Test 2:

| | | |
|---|---|---|
| preheat data | = | 400° F. for 16 minutes |
| preset time | = | 30 minutes |
| preset temp | = | 400° F. |
| max ambient | = | 450° F. |
| top heater max | = | 375° F. |
| middle heater max | = | 400° F. |
| bottom heater max | = | 425° F. |

Figure 22:
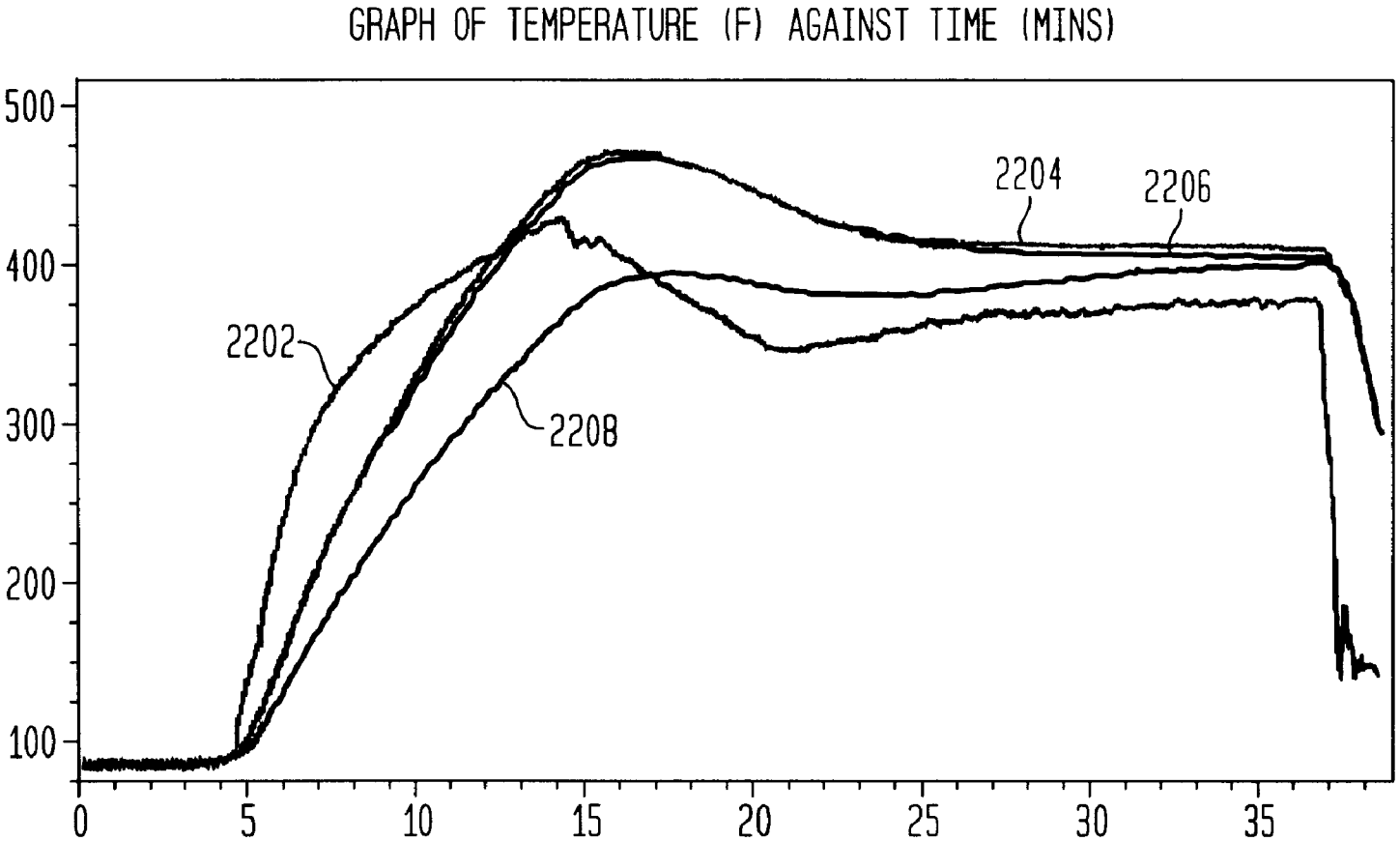
FIG. 22: A graphical representation of results for Test 2 using the oven.

The elements on FIG. 22 are:

Element 2202=bottom air temperature—first bottom sensor (peak temp=423)

Element 2204=side one of oven chamber (peak temp=464)

Element 2206=side two of oven chamber (peak temp=478)

Element 2208=bottom air temperature—second bottom sensor (peak temp=403)

C. Test 3

The following curing parameters 810 were used for Test 3:

| | | |
|---|---|---|
| preheat data | = | 350° F. for 16 minutes |
| preset time | = | 30 minutes |
| preset temp | = | 350° F. |
| max ambient | = | 400° F. |
| top heater max | = | 375° F. |
| middle heater max | = | 400° F. |
| bottom heater max | = | 425° F. |

Figure 23:
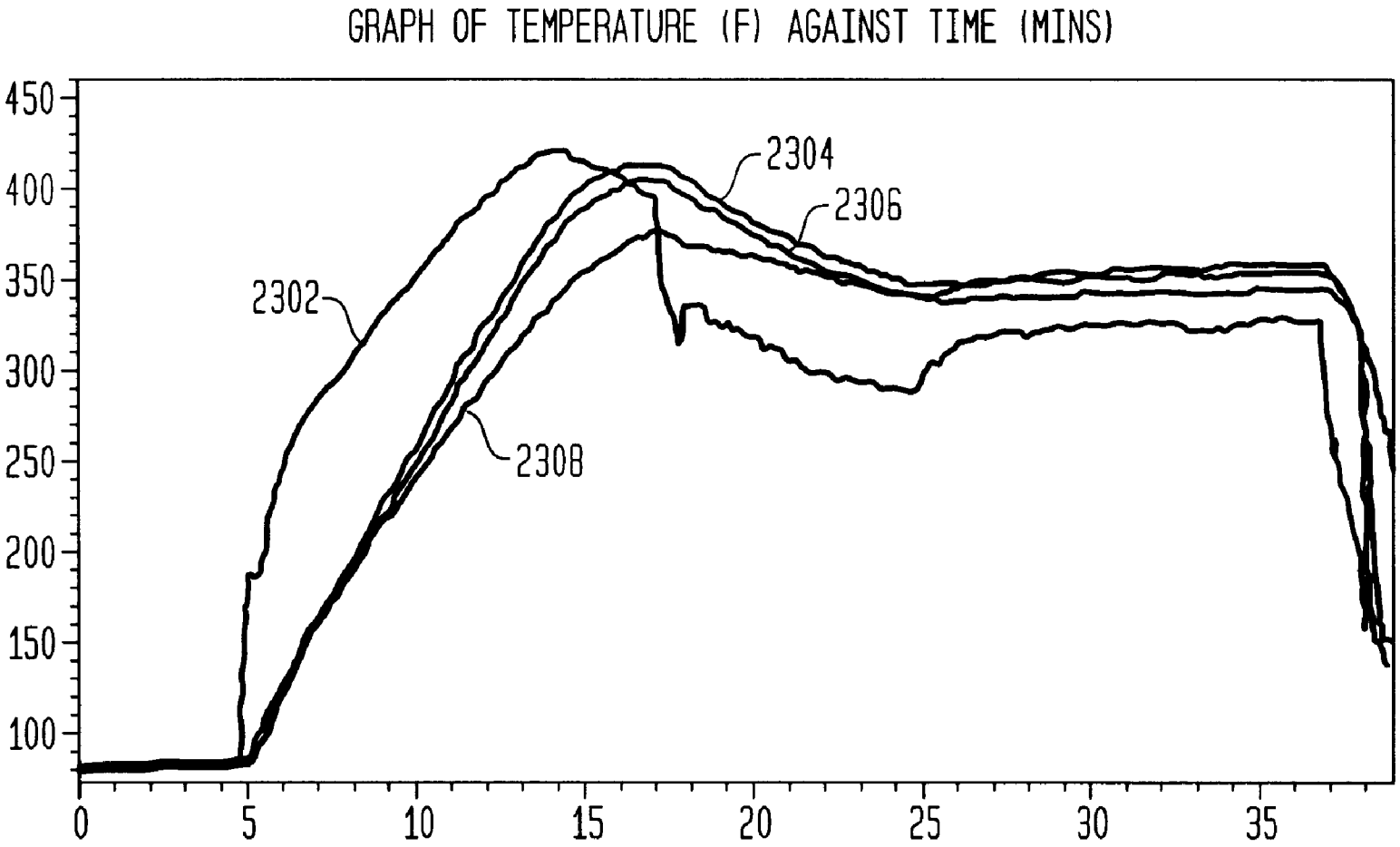
FIG. 23: A graphical representation of results for Test 3 using the oven.

The elements on FIG. 23 are:

Element 2302=top air temperature—first top sensor (peak temp=423)

Element 2304=side one of oven chamber (peak temp=415)

Element 2306=side two of oven chamber (peak temp=406)

Element 2308=top air temperature—second top sensor (peak temp=379)

D. Test 4

The following curing parameters 810 were used for Test 4:

| | | |
|---|---|---|
| preheat data | = | 350° F. for 16 minutes |
| preset time | = | 30 minutes |
| preset temp | = | 350° F. |
| max ambient | = | 400° F. |
| top heater max | = | 375° F. |
| middle heater max | = | 400° F. |
| bottom heater max | = | 425° F. |

Figure 24:
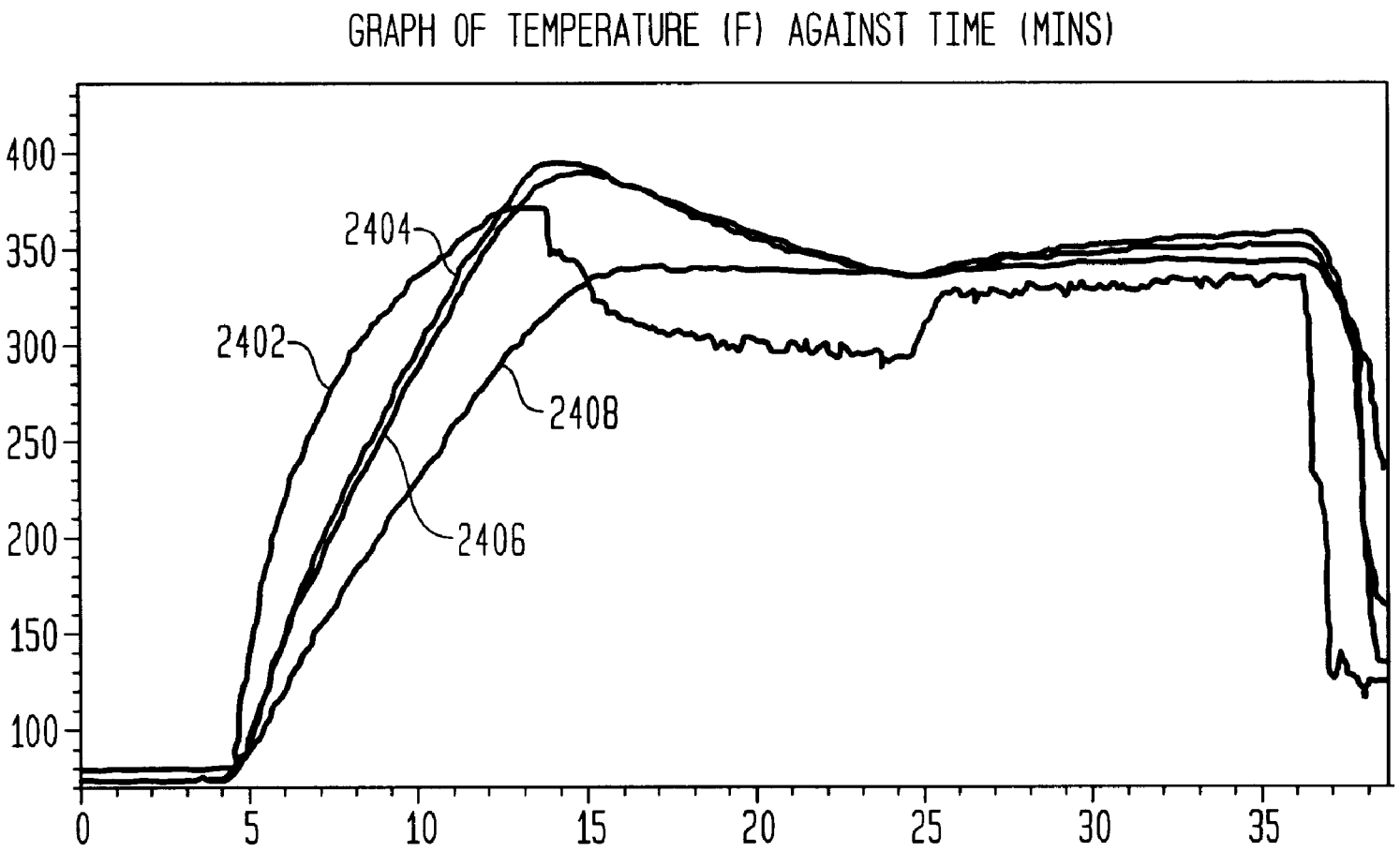
FIG. 24: A graphical representation of results for Test 4 using the oven.

The elements on FIG. 24 are:

Element 2402=bottom air temperature—first bottom sensor (peak temp=379)

Element 2404=side one of oven chamber (peak temp=403)

Element 2406=side two of oven chamber (peak temp=397)

Element 2408=bottom air temperature—second bottom sensor (peak temp=374)

Conclusion

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. An oven for heating an object, comprising:

an oven chamber;

one or more radiant heaters within said oven chamber;

a means for moving said radiant heaters, thereby controlling the direction of heat emitted from said radiant heaters; and an exhaust fan for drawing the heat through said oven chamber.

2. The oven according to claim 1, wherein said oven chamber has one or more pairs of radiant heaters, and one radiant heater of each said pair of radiant heaters is positioned on an opposing side of said oven chamber than the other radiant heater of each said pair of radiant heaters.

3. The oven according to claim 1, wherein said means for moving said radiant heaters comprises a means for pivotally mounting each said radiant heater within said oven chamber.

4. The oven according to claim 3, wherein said means for pivotally mounting comprising a means for moving said radiant heaters in a horizontal plane toward and away from the object.

5. The oven according to claim 3, wherein said means for pivotally mounting comprises a means for pivoting said radiant heaters about a central point, thereby moving the emitted heat in a vertical plane.

6. The oven according to claim 1, wherein a U-tube of each said radiant heater is rotatably connected to a rigidly mounted blower unit.

7. The oven according to claim 1, further comprising a computer system in communication with said radiant heaters for controlling the level of heat output from said radiant heaters.

8. The oven according to claim 7, further comprising:

a means for determining the temperature of the object within said oven chamber; and a means for communicating the temperature of the object to said computer system.

9. The oven according to claim 8, wherein said means for determining the temperature of the object is a water cooled infrared sensor.

10. The oven according to claim 7, further comprising:

a means for determining the ambient temperature within said oven chamber; and a means for communicating the ambient temperature to said computer system.

11. The oven according to claim 10, wherein said means for determining the ambient temperature within said oven chamber comprises one or more ambient temperature sensors.

12. The oven according to claim 7, wherein said computer system further controls said means for moving said radiant heaters.

13. The oven according to claim 1, further comprising one or more back panels, each said back panel positioned behind one or more said radiant heaters.

14. The oven according to claim 13, wherein said back panels are flat black.

15. The oven according to claim 1, further comprising a turbulent fan and a means for deflecting air flow from said turbulent fan through said oven chamber.

16. The oven according to claim 15, wherein said means for deflecting air flow is an air direction unit and one or more deflectors, such that air flow from said turbulent fan is directed around the comers of said oven chamber and toward the object.

17. The oven according to claim 15, further comprising a computer system in communication with said radiant heaters for controlling the level of output from said radiant heaters and with said turbulent fan.

18. The oven according to claim 1, wherein exhaust air from said exhaust fan is redirected back into said oven chamber of the oven.

19. The oven according to claim 18, wherein exhaust air re-enters said oven chamber through the bottom of said oven chamber.

20. The oven according to claim 1, further comprising a computer system in communication with said radiant heaters for controlling the level of output from said radiant heaters and with said exhaust fan.

21. A method for heating an object in an oven, the oven having an oven chamber, one or more radiant heaters within the oven chamber, a means for moving the radiant heaters, thereby controlling the direction of heat emitted from the radiant heaters, and an exhaust fan for drawing the heat through the oven chamber, the method comprising the steps of:

a. placing an object to be heated within the oven chamber;

b. moving the position of the radiant heaters according to the shape and size of the object to maximize the effectiveness of the heat emitted from the radiant heaters; and c. heating the object.

22. The method according to claim 21, wherein said step (b) comprises the step of:

(i) pivoting the radiant heaters about a central point thereby moving the heat emitted from the radiant heaters in a vertical plane.

23. The method according to claim 21, wherein said step (b) comprises the step of:

(i) moving the radiant heaters in a horizontal plane toward and away from the object.

24. The method according to claim 21, further comprising the steps of:

d. monitoring the temperature of the object within the oven chamber; and e. controlling the level of heat output from the radiant heaters according to the temperature of the object.

25. The method according to claim 24, further comprising the steps of:

f. receiving curing parameters directed to the size and shape of the object for use in said step (e).

26. The method according to claim 24, wherein said step (e) comprises the steps of:

(i) determining whether to turn on one or more radiant heaters;

(ii) turning on one or more radiant heaters when said step (e)(i) determines to turn on one or more radiant heaters;

(iii) determining whether to turn off one or more radiant heaters; and (iv) turning off one or more radiant heaters when said step (e)(iii) determines to turn off one or more radiant heaters.

27. The method according to claim 26, wherein the oven further has a turbulent fan and a means for directing the air flow from the turbulent fan through the oven chamber, and said step (e) further comprises the steps of:

(v) determining whether to turn on the turbulent fan;

(vi) turning on the turbulent fan when said step (e)(v) determines to turn on the turbulent fan;

(vii) determining whether to turn off the turbulent fan; and (viii) turning off the turbulent fan when said step (e)(v) determines to turn off the turbulent fan.

28. The method according to claim 26, wherein the oven further has one or more ambient temperature sensors for determining the ambient temperature within the oven chamber, and said step (e)(i) uses the ambient temperature in determining whether to turn on one or more radiant heaters and said step (e)(iii) uses the ambient temperature in determining whether to turn off one or more radiant heaters.

29. An oven for heating an object, comprising:

an oven chamber;

a first means for heating said oven chamber using radiant heat;

a second means for heating said oven chamber using ambient heat;

one or more adjustable object sensors for reading a temperature of an appropriate spot on the object, the appropriate spot being determined by the size and shape of the object; and a means for controlling said first means for heating and said second means for heating, wherein said means for controlling inputs the temperature of the appropriate spot on the object from said one or more adjustable object sensors.

30. The oven according to claim 29, wherein said first means for heating comprises one or more radiant heaters.

31. An oven for heating an object, comprising:

an oven chamber;

a first means for heating said oven chamber using radiant heat, wherein said first means for heating comprises one or more radiant heaters pivotally mounted to control the direction of the heat emitted from said radiant heaters toward the object;

a second means for heating said oven chamber using ambient heat; and a means for controlling said first means for heating and said second means for heating.

32. The oven according to claim 31, further comprising a means for determining the temperature of the object and a means for determining the ambient temperature within the oven chamber, wherein said means for controlling turns said radiant heaters on or off according to the temperature of the object and the ambient temperature within said oven chamber.

33. The oven according to claim 29, further comprising a third means for heating said oven chamber using convection heat.

34. The oven according to claim 33, wherein said third means for heating comprises a turbulent fan and a means for deflecting air flow from said turbulent fan through said oven chamber.

35. An oven controller computer program product for use with an oven having an oven chamber, one or more radiant heaters within the oven chamber, a means for moving the radiant heaters, thereby controlling the direction of heat emitted from the radiant heaters, an exhaust fan for drawing the heat through the oven chamber, and a host computer system for controlling the level of heat emitted from the radiant heaters, comprising:

a computer program medium having computer readable program code means embodied in said computer program medium for interfacing with the host computer system and the one or more radiant heaters, said computer readable program code means comprising:

means for enabling the host computer system to determine the temperature of the object;

means for enabling the host computer system to turn on one or more radiant heaters; and means for enabling the host computer system to turn off one or more radiant heaters.

36. The oven controller computer program product according to claim 35, further comprising:

means for enabling the host computer to determine the ambient temperature within the oven chamber, wherein said means for enabling the host computer system to turn on one or more radiant heaters and said means for enabling the host computer system to turn off one or more radiant heaters uses the ambient temperature.

37. The oven controller computer program product according to claim 36, further comprising a means for enabling the host computer to signal an alarm when said means for enabling the host computer to determine the ambient temperature within the oven chamber determines that the ambient temperature rises above a maximum ambient temperature.

38. The oven controller computer program product according to claim 35, wherein the oven further has a turbulent fan and a means for deflecting the air flow from the turbulent fan through the oven chamber, further comprising:

a means for enabling the host computer to determine whether to turn on the turbulent fan; and a means for enabling the host computer to determine whether to turn off the turbulent fan.

39. The oven controller computer program product according to claim 35, further comprising:

a means for enabling the host computer to signal the completion of the heating process.

* * * * *